US007500487B2

(12) United States Patent
Kobayashi et al.

(10) Patent No.: US 7,500,487 B2
(45) Date of Patent: Mar. 10, 2009

(54) HAIR TREATING IMPLEMENT

(75) Inventors: Hideo Kobayashi, Tochigi (JP); Takehiko Tojo, Tochigi (JP); Naohiro Kariya, Tokyo (JP); Shingo Odajima, Tochigi (JP)

(73) Assignee: Kao Corporation, Tokyo (JP)

( * ) Notice: Subject to any disclaimer, the term of this patent is extended or adjusted under 35 U.S.C. 154(b) by 340 days.

(21) Appl. No.: 10/484,262

(22) PCT Filed: Jul. 18, 2002

(86) PCT No.: PCT/JP02/07318

§ 371 (c)(1),
(2), (4) Date: Jun. 23, 2004

(87) PCT Pub. No.: WO03/007752

PCT Pub. Date: Jan. 30, 2003

(65) Prior Publication Data

US 2004/0231689 A1 Nov. 25, 2004

(30) Foreign Application Priority Data

| | | | |
|---|---|---|---|
| Jul. 19, 2001 | (JP) | ..... | 2001-220362 |
| Jul. 19, 2001 | (JP) | ..... | 2001-220387 |
| Oct. 3, 2001 | (JP) | ..... | 2001-307018 |
| May 7, 2002 | (JP) | ..... | 2002-132018 |

(51) Int. Cl.
*A45D 2/00* (2006.01)

(52) U.S. Cl. ..... 132/222

(58) Field of Classification Search ..... 132/222, 132/270, 200, 210, 223, 224, 55, 245, 269, 132/207, 201, 53; 54/87, 75, 76, 78; 119/809–811
See application file for complete search history.

(56) References Cited

U.S. PATENT DOCUMENTS

| | | | | |
|---|---|---|---|---|
| 148,367 | A * | 3/1874 | Howard | 54/78 |
| 385,721 | A * | 7/1888 | Muntz | 54/78 |
| 3,255,765 | A | 6/1966 | Sturdivant | |
| 3,968,805 | A * | 7/1976 | Sobeck, Jr. | 132/270 |
| 5,752,530 | A * | 5/1998 | Traintinger | 132/201 |

(Continued)

FOREIGN PATENT DOCUMENTS

| | | |
|---|---|---|
| JP | 11-14546 | 10/1936 |

(Continued)

OTHER PUBLICATIONS

U.S. Appl. No. 10/542,357, filed Jul. 14, 2005, Tojo et al.

(Continued)

*Primary Examiner*—Robyn Doan
(74) *Attorney, Agent, or Firm*—Oblon, Spivak, McClelland, Maier & Neustadt, P.C.

(57) ABSTRACT

A hairdressing tool includes a slender hair holder having a hair inlet at one end thereof and made of a flexible material, a hair inserter for inserting hair in or through the hair holder, and a curler for rolling, curving or bending the hair held by the hair holder into a prescribed shape. A hairdressing method includes holding a prescribed amount of hair in or through a slender hair holder of a hairdressing tool, the hair holder including a flexible material and being capable of holding hair, and rolling, curving or bending the hair held by the hair holder by a prescribed curler possessed by the hair holder.

17 Claims, 21 Drawing Sheets

U.S. PATENT DOCUMENTS

| | | | | |
|---|---|---|---|---|
| 5,771,906 | A * | 6/1998 | De Benedictis | 132/207 |
| 6,109,274 | A * | 8/2000 | Ingersoll | 132/201 |
| 6,260,555 | B1 * | 7/2001 | Natvig | 132/200 |
| 6,647,989 | B1 * | 11/2003 | De Benedictis | 132/210 |
| 2004/0231689 | A1 | 11/2004 | Kobayashi et al. | |

FOREIGN PATENT DOCUMENTS

| | | |
|---|---|---|
| JP | 57-99502 | 6/1982 |
| JP | 62-117902 | 7/1987 |
| JP | 63-117402 | 7/1988 |
| JP | 1-138301 | 9/1989 |
| JP | 6-37762 | 10/1994 |
| JP | 8-10035 | 1/1996 |
| JP | 10-94419 | 4/1998 |
| JP | 10-117836 | 5/1998 |
| JP | 10-192036 | 7/1998 |
| JP | 10-192938 | 7/1998 |
| WO | 00/57744 | 10/2000 |
| WO | WO 00/76358 A1 | 12/2000 |

OTHER PUBLICATIONS

U.S. Appl. No. 10/562,977, filed Dec. 29, 2005, Tojo et al.
U.S. Appl. No. 12/066,279, filed Mar. 10, 2008, Tojo et al.

* cited by examiner

Evaluation standard:

circle ... capable of rolling itself into neat circle cross ... incapable of rolling itself into circle

| Flexible Maretial | Taber Stiffness |
|---|---|
| ① PE nonwoven fabric (250 μm) | 0.09 |
| ② LDPE (30 μm) | 0.03 |
| ③ PET nonwoven fabric (150 μm) | 0.22 |
| ④ PET nonwoven fabric (300 μm) | 2.00 |
| ⑤ copying paper (100 μm) | 0.75 |

HAIR TREATING IMPLEMENT

TECHNICAL FIELD

The present invention relates to a hairdressing tool with which a prescribed amount of hair can easily be treated. The present invention also relates to a hairdressing tool for styling one's hair as desired. The present invention also relates to a hairdressing tool used to roll hair into a prescribed shape in curling hair, for example, in permanent waving. The present invention also relates to various hairdressing methods including permanent waving and coloring.

BACKGROUND ART

It has long been known to use a sheet material to curl hair as disclosed, e.g., in JP-U-11-14546, but it is difficult to handle hair with such a sheet material.

In order to facilitate handling and curling hair, JP-A-10-192036 proposes a tubular hair rolling tool and a method of hair rolling. This tubular hair rolling tool has a great merit in that a strand of hair can be handled much more easily.

The hair rolling tool of JP-A-10-192036 has a plastically deformable member attached along the longitudinal direction of the tube. The plastically deformable member is freely bendable and can be retained in a bent shape. With a strand of hair put in the tube, the plastically deformable member is deformed to keep the hair in the deformed state. The hair rolling tool is used in combination with a hair drawing tool. The hair drawing tool is a stick having integrally formed at the end thereof a loop through which a strand of hair is slipped.

Because the hair rolling tool is made of a low stiff material such as Japanese paper or nonwoven fabric, the opening of the hair rolling tool is deformed easily when a parted strand of hair is passed through the loop of the hair drawing tool. As a result, the hair and the loop of the hair drawing tool are apt to be caught on the opening edge, making it difficult to smoothly inserting the hair inside the hair rolling tool. Besides, the loop of the hair drawing tool is made of a plastic material, which makes the hair and the loop more apt to be caught on the opening edge of the hair rolling tool. The larger the loop of the hair drawing tool, the more easily is hair slid therethrough. However, the loop of the hair drawing tool cannot be made larger than the opening of the hair rolling tool because of its material rigidity.

The publication says that, in doing a perm using the hair rolling tool, a permanent wave solution is applied before rolling up hair, and the flat tube is then rolled by hand. Since the hair should be rolled by hand as has been conventionally done, the permanent waving still takes a lot of trouble. The tools are not easily manageable for users to roll up their hair by themselves so that rolling takes them a lot of time and trouble.

Moreover, where the hair rolling tool has a tubular form, the inner and the outer sheets necessarily generate strain on being deformed. The strain becomes greater as the amount of hair held in the tubular hair rolling tool increases or as the curvature of curls becomes larger. If hair is curled without eliminating the strain, it will not be curled into a neat ring but an odd polygonal shape.

JP-U-6-37762 discloses a hair curler composed of two flexible sheets superposed on each other and joined along both sides. One of the flexible sheets composing the hair curler is made of a shape-memory material which can return to its original rolled shape, and the other is a mesh sheet or a nonwoven fabric sheet. The two sheets are detachably joined along one of the sides. It is easy with this hair curler to roll up hair. However, it is difficult to put a strand of hair in the hair curler before rolling.

WO 00/57744 discloses a tubular hairdressing tool as an auxiliary in waving hair by a perm, etc., which is formed of a mesh sheet and has extensibility in both longitudinal and transverse directions. A strand of hair is inserted through the tubular hairdressing tool being extended in the transverse direction and contracted in the longitudinal direction. The tube is extended, then deformed by, for example, twisting at two or more positions together with the hair, and maintained in that state for a prescribed period of time to curl the hair. However, while or after a strand of hair is inserted through the tube, the tip of the hair tends to be bent backward or irregularly waved with the tube contracting, resulting in a failure to curl the hair beautifully.

Accordingly, an object of the present invention is to provide a hairdressing tool having a tube in which a strand of hair can be inserted easily and rapidly.

Another object of the present invention is to provide a hairdressing tool, with which a strand of hair can be rolled up easily and rapidly.

Still another object of the present invention is to provide a hairdressing tool, with which hair can be waved easily.

Yet another object of the present invention is to provide a hairdressing tool, with which hair can be curled easily, securely, and neatly.

An additional object of the present invention is to provide a hairdressing method which makes it easy to do a hairdressing treatment such as permanent waving or coloring.

DISCLOSURE OF THE INVENTION

The present invention accomplishes the above objects by providing a hairdressing tool comprising a slender hair holder having a hair inlet at one end thereof and comprising a flexible material, a hair inserter for inserting hair in or through the hair holder, and a curling member for rolling, curving or bending the hair held by the hair holder into a prescribed shape.

The present invention also accomplishes the above objects by providing a hairdressing method comprising holding a prescribed amount of hair in or through a slender hair holder of a hairdressing tool, the hair holder comprising a flexible material and being capable of holding hair, and rolling, curving or bending the hair held in the hair holder by means of a prescribed curling member attached to the hair holder.

BEST MODE FOR CARRYING OUT THE INVENTION

Figure 1:
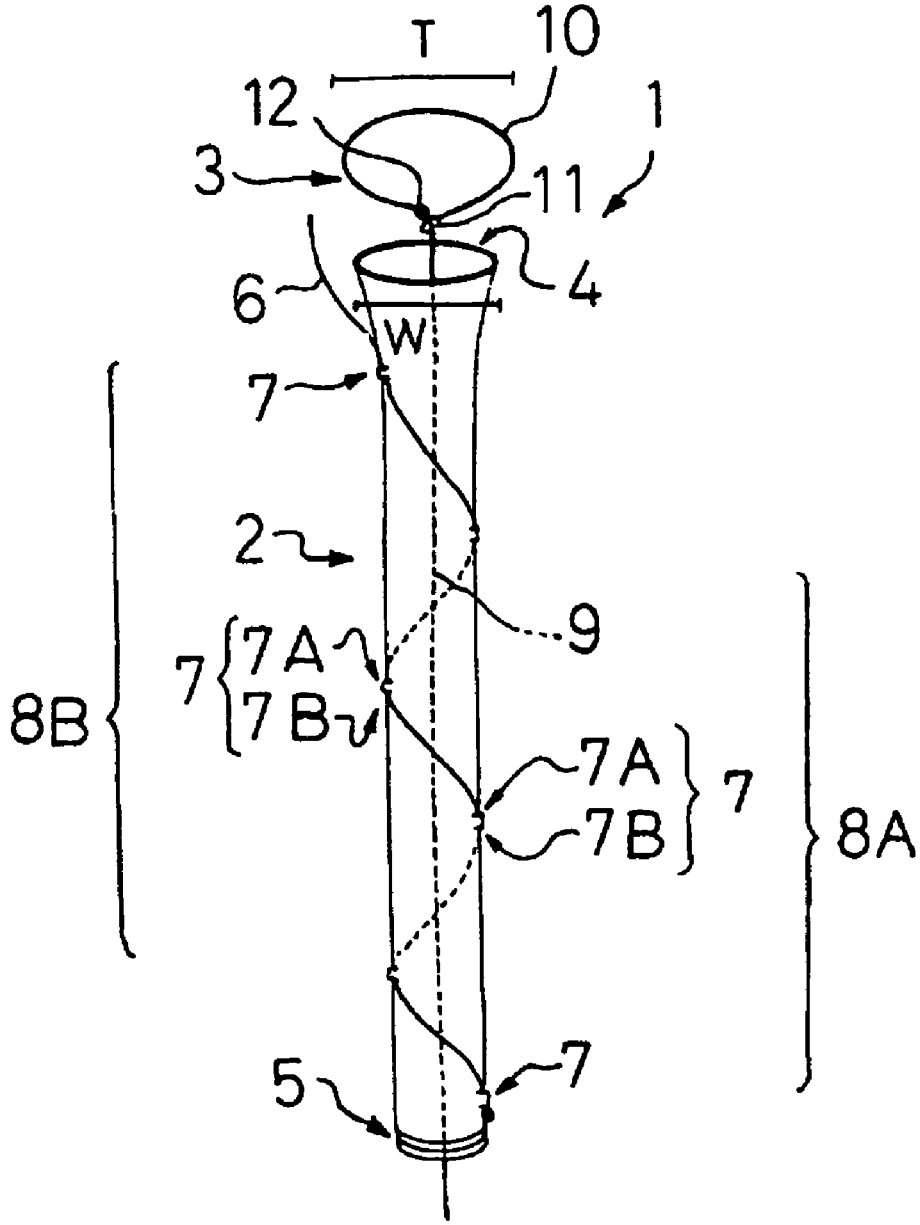
FIG. 1 is a perspective view showing an embodiment of a hairdressing tool of the present invention.
Figure 2A:
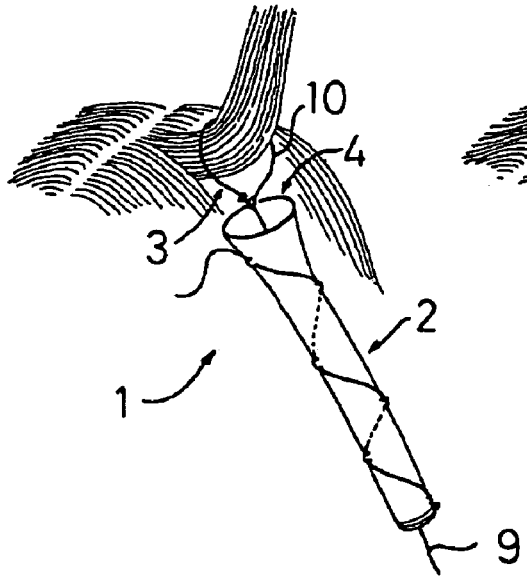
FIG. 2(*a*), FIG. 2(*b*), FIG. 2(*c*), and FIG. 2(*d*) show steps of hairdressing using the hairdressing tool of FIG. 1.
Figure 2B:
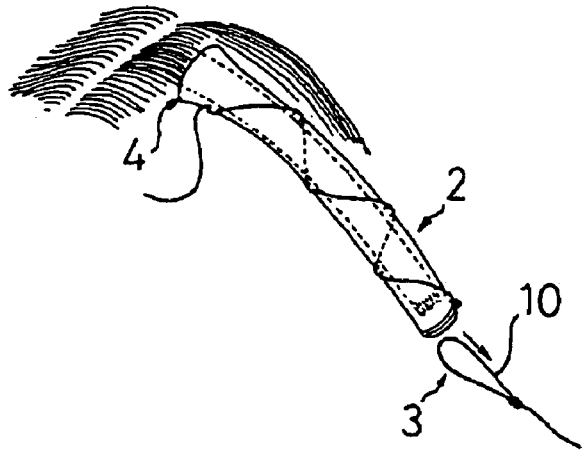
Figure 2C:
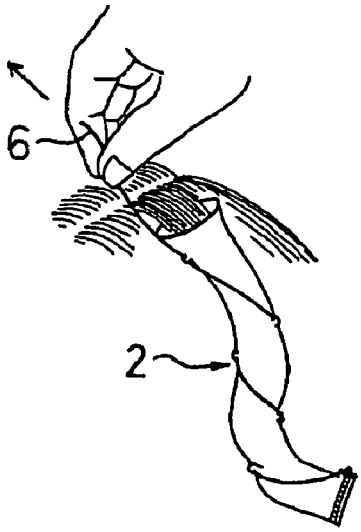
Figure 2D:
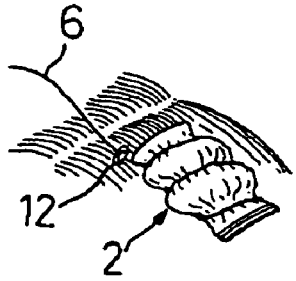

The present invention will be described based on its preferred embodiments with reference to the accompanying drawings. FIG. 1 is a perspective view showing an embodiment of the hairdressing tool of the present invention. The hairdressing tool 1 comprises a slender hair holder 2 which is adapted to hold a strand of hair and a hair inserter 3.

The hair holder 2 is a slender tube made of a flexible material, in which hair is inserted and held. The hair holder 2 has one end and the other end which are open. The upper end provides a hair inlet 4. The other end, i.e., the lower end has a zipper 5 as a fastening for the lower end, so that the lower end may be opened and closed. The fastener includes a surface fastener (hook and loop fastener), an adhesive tape, and a self-adhesive tape (e.g., Fushigi Tape (trade name) of Nirei Industry Co., Ltd.) as well as a zipper. The length of the hair holder 2 is decided according to the length of hair to be treated, desirably larger than the length of hair to be treated. The length of the hair holder 2 usually ranges about 50 to 600 mm.

The hair inlet 4 has the shape of a funnel with its diameter increasing toward the opening. By this design, when a strand of hair is put into the hair holder 2 with the hair inserter 3, the hair and the inserter 3 are hardly caught on the hair inlet 4, and the hair can easily be inserted. The hair inlet 4 and its vicinity are made more rigid than the other par of the hair holder 2. By this design, the hair inlet 4 is hardly deformed even if it catches the hair or the hair inserter 3 when the hair is pulled in. As a result, hair can easily be inserted. Where the hair holder 2 is produced by resin molding, the hair inlet 4 and its vicinity can be made more rigid than the other part by making them thicker-walled than the other part. Where the hair holder 2 is made of nonwoven fabric or mesh, the hair inlet 4 and its vicinity can be made more rigid by sticking thereto a stiff material such as a plastic sheet or paperboard.

The hair inlet 4 is preferably shaped for easy passage of a strand of head. For example, the shape of the opening of the hair inlet 4 is preferably a circle or an ellipse having a major axis to minor axis ratio close to 1 for securing easy passage. Additionally it is preferred that the hair inlet 4 have a largest width W (see FIG. 1) of 5 to 200 mm, particularly 10 to 90 mm, at the opening edge for securing ease of hair insertion, ease of handling, and manageability in good balance.

Various flexible materials are used to make the hair holder 2. Examples include nonwoven fabric, porous or nonporous resin films, paper, resin meshes, and composites thereof, from which an appropriate one is selected according to the particular use of the hairdressing tool 1. When, for instance, the hair inserted in the hair holder 2 is to be treated with a hair treating agent, a material impermeable to the hair treating agent is chosen where the hair treating agent must be applied only to the inserted hair, or a material permeable to the hair treating agent is selected where the hair treating agent is to be applied to the inserted hair through the wall of the hair holder 2.

As shown in FIG. 1, the hair holder 2 has, as a curling member, a curling thread 6 helically wound around the outer side thereof. The curling thread 6 is used as means for curling the strand of hair inserted in the hair holder 2 together with the hair holder 2. The term "curling" is used herein as a generic term meaning giving a prescribed set to hair, including rolling up, curving and bending hair. The curling thread 6 is threaded through a plurality of through-holes 7 that are provided on the hair holder 2 at intervals along a helix. When the hair holder 2 is seen from the front, the through-holes 7 are provided on both longitudinal sides of the hair holder 2 and arranged on each side at a given interval to make respective lines of through-holes, designated lines 8A and 8B. The arrangement of the through-holes 7 is such that a line connecting all the through-holes 7 in a vertical sequence along the surface of the hair holder 2 depicts a helix.

Each through-hole 7 has a pair of small openings 7*a* and 7B. The size of the openings 7A and 7B is such as to allow the curling thread 6 to pass through. Such through-holes with small openings can be formed by making small cuts in the hair holder 2. The curling thread 6, which is wound around the outer surface of the hair holder 2, runs on the inner side of the hair holder 2 only in between the pair of openings 7A and 7B. Thus, the curling thread 6 is duly held onto the outer side of the hair holder 2.

The tailing end of the curling thread 6 is prevented from being unthreaded through the lowest through-hole 7 of the hair holder 2 (the lowest one of the line 8A in FIG. 1). Specifically, the end of the curling thread 6 is fixed to the hair holder 2 so as not to be pulled out. The curling thread 6 can be fixed by adhesion with an adhesive or by thermal fusion. The curling thread 6 may also be prevented from being pulled out by tying the tailing end of the thread 6 into a knot bigger than the small opening, whereby the knot is caught on the opening. On the other hand, the other end of the curling thread 6 remains free after being threaded through the highest through-hole 7 of the hair holder 2 (the highest one in the line 8B in FIG. 1). In this way, the hair holder 2 is designed to be deformed into a helix by pulling the free end of the curling thread 6 (described later).

It is preferred for the curling thread 6 to have sufficient strength not to be cut when pulled to curl the hair and softness enough to smoothen the pulling operation. From this viewpoint, the curling thread 6 is preferably made of synthetic materials such as various resins, naturally occurring materials such as cotton or hemp, semi-synthetic materials such as rayon, various metals, or composites thereof. The curling thread 6 is not limited to a thread and may be a narrow strip.

The hair inserter 3 is then described by referring to FIG. 1. The hair inserter 3 has a long pulling member 9 and a hair catching member 10 provided at a tip of the pulling member 9. The hair catching member 10 is deformable and is used to catch a strand of hair to be inserted into the hair holder 2. According to the present embodiment, the hair inserter 3 is formed of a single wire. In detail, the wire forms a tiny loop 11 at one end, through which the other end is passed to make a large loop, i.e., the hair catching member 10. A stopper 12 of a size that is not allowed to pass through the tiny loop 11 is provided at a predetermined position of the large loop. The hair inserter 3 is used as followed. The hair catching member 10 is enlarged up to a size enough to catch up a strand of hair, and a strand of hair is passed through the hair catching member 10. The pulling member 9 is drawn to narrow the hair catching member 10 to the size regulated by the stopper 12. The wire forming the hair inserter 3 can be of the materials recited above as for the curling thread 6. From the standpoint of manageability, ease of handling, and anticorrosion against hair treating agents, a metal wire coated with a synthetic resin is particularly preferred.

The hair inserter 3 works in the state inserted in the hair holder 2. In detail, as shown in FIG. 1, it is used as inserted in the hair holder 2 with its hair catching member 10 facing the hair inlet 4. The hair inserter 3 may have previously been inserted in the hair holder 2 to make up a hairdressing tool 1 before use. Otherwise, the hair inserter 3 may be inserted in the hair holder 2 each time the hairdressing tool 1 is used. It would be better, nevertheless, that the hair inserter 3 is attached to the hair holder 2 in the best condition available on the production line, thereby excluding a possible failure of attachment by a user each time of use. Because the hair inserter 3 is not required to have strength for attachment, a simply fabricated inexpensive material, such as a thread or a film, can serve as a hair inserter 3. Therefore, the hair inserter 3 can be produced with high productivity at low cost. On use of the hairdressing tool 1, the hair catching member 10 of the hair inserter 3 is made to stick out of the hair inlet 4 of the hair holder 2. A desired amount of hair is caught in-the hair catching member 10, and the pulling member 9 of the hair inserter 3 that sticks out of the other end of the hair holder 2 is pulled out. In this way the hair caught on the hair catching member 10 is inserted together with the hair catching member 10 through the hair holder 2. After the hair catching member 10 enters the hair holder 2, it releases the hair at a certain position in the hair holder 2, and the hair is thus inserted into the hair holder 2 smoothly. The hair catching member 10 is then pulled outside from the lower end of the hair holder 2. As is obvious from the foregoing explanation, the total length of the hair inserter 3 is larger than that of the hair holder 2.

Since the hair catching member 10 of the hair inserter 3 is deformable, even if the hair catching member 10 having caught a strand of hair comes into contact with the hair inlet 4 when entering the hair holder 2, it is capable of changing it shape in conformity with the size of the hair inlet 4 and therefore leading the hair into the hair holder 2 smoothly. According to the present embodiment, in particular, since the hair inlet 4 and its vicinity are rigid, deformation of the hair catching member 10 on contact with the hair inlet 4 is accelerated, which further improves the smoothness of hair insertion.

The circumference of the hair catching member 10 of the hair inserter 3 is larger than that of the hair inlet 4 of the hair holder 2. The larger the circumstance of the hair catching member 10, the more easily the hair passes through the catching member 10. If the hair catching member 10 is not deformable, the possible largest circumference of the hair catching member 10 would be limited by the circumference of the hair inlet 4. Being deformable, the hair catching member 10 of the present embodiment is allowed to have a larger circumference than that of the hair inlet 4. As a result, it is easy to catch hair through the hair catching member 10. In the present embodiment, the circumference of the hair catching member 10 means the minimum circumference of the loop as regulated with the stopper 12. Taking ease of catching hair and manageability and handling properties of the hair inserter 3 into consideration, the hair catching member's circumference is preferably larger than, and not more than 10 times as large as, the circumference of the hair inlet 4, still preferably larger than, and not more than 5 times as large as, the circumference of the hair inlet 4. From the same viewpoint, the absolute circumference of the hair catching member 10 is preferably 40 to 500 mm, particularly 80 to 200 mm.

From the same viewpoint as described above, the hair catching member 10 of the hair inserter 3 is designed to have a maximum width T (see FIG. 1) larger than the maximum width W of the hair inlet 4 of the hair holder 2. The maximum width T of the hair catching member 10 means the greatest width reachable by the hair catching member 10 in any deformed state. In this embodiment, the maximum width T of the hair catching member 10 is the value measured when narrowing of the loop (hair catching member 10) is stopped by the stopper 12. From the standpoint of ease of catching hair and manageability and handling properties of the hair inserter 3, the maximum width T of the hair catching member is preferably larger than, and not more than 10 times as large as, particularly larger than, and not more than 5 times as large as, the maximum width W of the hair inlet 4. From the same standpoint, the absolute maximum width T of the hair catching member 10 is preferably 20 to 250 mm, particularly 40 to 100 mm.

While not shown in the Figure, it is preferred for the hair catching member 10 to have comb teeth. The hair catching member 10 with comb teeth exerts a combing effect while leading the hair through the hair holder 2, so that the hair is uniformly distributed in the hair holder 2 to make a hair treatment (hereinafter described) uniform. From this viewpoint, the teeth are preferably directed inwardly, i.e., toward the center of the loop of the hair catching member 10.

A hairdressing method using the hairdressing tool according to the present embodiment will be described by way of FIGS. 2(*a*) through 2(*d*) with particular reference to permanent waving. First of all, a hairdressing tool 1 is prepared, which comprises a hair holder 2 and a hair inserter 3 inserted in the hair holder 2 with a hair catching member 10 of the hair inserter 3 sticking out of a hair inlet 4 of the hair holder 2 as shown in FIGS. 2(*a*). From the lower end of the hair holder 2, the tail of a pulling member 9 of the hair inserter 3 sticks out. In the present embodiment, the hair holder 2 is made of a material permeable to a permanent waving preparation, such as nonwoven fabric or a resin-made mesh. In this state, a desired amount of hair is parted and slipped through the hair catching member 10 of the hair inserter 3. As illustrated, it is desirable that the hair catching member 10 be positioned near the root of the strand of hair to insert hair surely.

As shown in FIG. 2(*b*), the hair holder 2 is lightly pressed with a hand (not shown) at a position near the hair inlet 4, and the tail (not shown) of the pulling member 9 of the hair inserter 3, which sticks out of the lower end of the hair holder 2, is held in another hand (not shown) and pulled to get the hair inserter 3 out of the hair holder 2. By so doing, the hair looped through the hair catching member 10 is successfully inserted and held in the hair holder 2. The hair holder 2 being longer than the length of hair to be held, the strand of hair is held in the hair holder 2 over the whole length thereof.

After the hair is inserted in the hair holder 2, the hair holder 2 is lightly pressed at the vicinity of the hair inlet 4 with one hand (not shown), and the free end of the curling thread 6 is pulled as shown in FIG. 2(*c*). Whereupon, the hair is helically rolled up and gathered into tiny knots together with the hair holder 2 as shown in FIG. 2(*d*). In order to retain this state, the root of the curling thread 6 emerging the hair holder 2 is fixed with a clip 12 as fixing means. The means for fixing the curling thread 6 includes not only the clip 12 but (1) a method in which a cut is made in the edge of the hair inlet 4, in which the curling thread 6 is caught, (2) a method in which the curling thread 6 is backward threaded through the nearest hole of the hair holder 2 through which the curling thread 6 has just been threaded (see FIG. 15 explained later), (3) a method in which a member having an increased frictional force against the curling thread 6 is provided, (4) a method in which a knot is made in the curling thread 6, and (5) a method in which the curling thread 6 is designed to be allowed to move only one direction (e.g., a ratchet mechanism). Of the fixing means described, the methods (2) to (5), which make use of a frictional force for fixing the above-mentioned state, are preferably adopted.

The above-described series of operations are conducted on all the hair to be permanent waved. After that, a first permanent wave solution (reducing agent) is supplied to the hair holder 2. Since the hair holder 2 is made of a material permeable to permanent waving preparations as stated previously, the permanent wave solution is applied to the hair through the hair holder 2. After an elapse of a given time, a second permanent wave solution (oxidizing agent) is then supplied to the hair holder 2, and the hair is again left to stand for a given time. As a result, the hair is permanent waved to the rolled shape. Thereafter the clip 12 is removed to undo the hair, the hair holder 2 is removed, and the hair is rinsed, shampooed, and blown into style.

Figure 3:
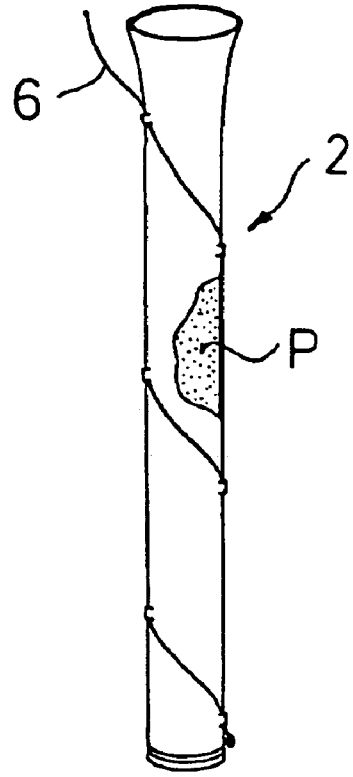
FIG. 3 shows another embodiment of a hair holder.

Alternatively, the permanent wave treatment can be performed as shown in FIG. 3, in which the first permanent wave solution P has previously been applied to the inner side of the hair holder 2. According to this process the step of supplying the first permanent wave solution from the outside of the hair holder 2 after rolling up hair can be omitted.

Still alternatively, the step of rolling hair is not conducted after the hair is inserted into the hair holder 2. In this case, the process is called permanent straightening. To ensure hair straightness, the hair holder is preferably made of a material that is flexible and yet relatively rigid.

According to the above-described permanent waving process, hair can be rolled up extremely easily and rapidly. After the permanent wave treatment, the step of undoing hair is carried out more easily and rapidly than in the case of using perm rods.

Hair coloring is then described as another embodiment of the hairdressing method. The coloring will be described only with respect to differences from the permanent wave treatment so that the description of the permanent wave treatment applies appropriately to those particulars that are not described here. The same hairdressing tool as used in the permanent wave treatment can be used in coloring, except that the hair holder 2 used in this particularly embodiment is made of a material impermeable to hair dyes, such as a synthetic resin film.

Figure 4:
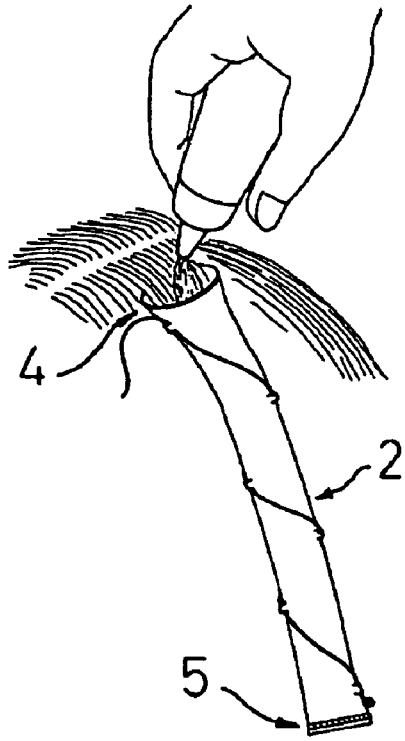
FIG. 4 illustrates another step of hairdressing.

Insertion of a strand of hair into the hair holder 2 is carried out in the same manner as in the permanent wave treatment (FIGS. 2(*a*) and 2(*b*)). After the insertion, the zipper 5 at the lower end of the hair holder 2 is closed. A hair dye is fed into the hair holder 2 through the hair inlet 4 as shown in FIG. 4 and distributed throughout the strand. As stated, since the hair holder is made of a material impermeable to hair dyes, and the lower end of the hair holder 2 is closed, the dye never leaks out of the hair holder 2. The hair other than the strand of hair inserted in the hair holder is thus prevented from being colored. Accordingly, this hairdressing method is especially effective in partial or spot hair coloring. In addition because the hair dye is maintained within the hair holder in a relatively air tight condition, the dye is prevented from losing its volatile component and thereby effectively achieves hair coloring.

After the hair is inserted in the hair holder 2, the hair is rolled upward as shown in FIG. 2(*c*). It may be a part of or the whole length of the strand of hair that is inserted in the hair holder 2 and rolled up. The root of the curling thread 6 coming out of the hair holder 2 is fixed with a clip 12. The strand of hair is rolled up into tiny knots in order to, for one thing, retain the strand in a desired shape and, for another, facilitate the operation of inserting another strand of hair near that strand into another hair holder 2.

The above-described series of operations are repeated as desired. After an elapse of a given time, the clip 12 is removed from the curling thread 6 to undo the hair, and the hair released from the holder 2 is rinsed, shampooed, and blown into style.

Alternatively, hair coloring can be performed by a process in which the hair dye has previously been applied to the inner side of the hair holder 2 (see FIG. 3). According to this process the step of supplying the hair dye from the hair inlet 4 after insertion of hair can be omitted.

Hairdressing methods further include a still another embodiment in which hair is treated with hairdressing cosmetics such as a hair styling preparation as a hair treating agent. In this embodiment, a hairdressing cosmetic is applied to wet or dry hair, and the hair is inserted in the hair holder and rolled up in the same manner as described above. The hair is maintained in this rolled state for, e.g., about one hour where dry hair is treated or, e.g., overnight where wet hair is treated, thereby to set the hair in a desired style.

Hairdressing methods furthermore include a yet another embodiment in which a rolled strand of hair is heated to get set. In detail, wet or dry hair is helically rolled up together with the hair holder 2 into tiny knots according to the procedures shown in FIGS. 2(*a*) through 2(*d*). In this state, the hair is heated with a heater, such as a hair drier to set the hair. Alternatively, wet hair is helically rolled together with the hair holder 2 into tiny knots according to the procedures shown in FIGS. 2(*a*) through 2(*d*). In this state, the hair is allowed to dry spontaneously to get set. When this hairdressing treatment is conducted after shampooing and before going to bed, the hair will have been set in a desired style by the next morning.

In addition to the above-described embodiments, the present invention provides the following embodiments. While the hair holder 2 according to the foregoing embodiments have two lines of through-holes, 8A and 8B, through which to hold the curling thread 6 on the outer side thereof, a hair holder having only one line of through-holes will do.

Figure 5A:
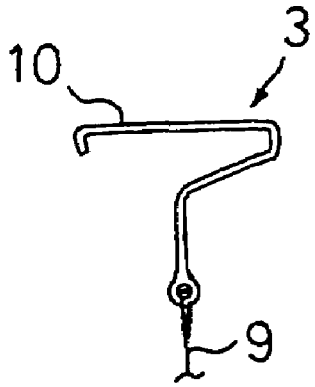
FIG. 5(*a*) and FIG. 5(*b*) show other embodiments of a hair inserter.
Figure 5B:
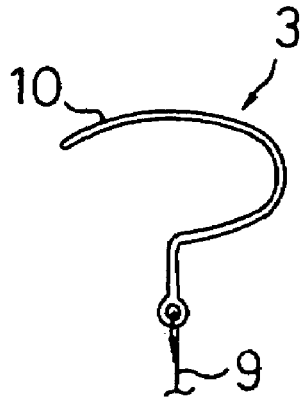

The hair inserter 3 with a loop as a hair catching member as used in the above-described embodiments can be replaced with a hair inserter 3 with a hook 10 shown in FIG. 5(*a*) or 5(*b*). In order to insert hair surely, it is preferred for the hook 10 to be made of metal or plastic and be non-deformable.

Figure 6:
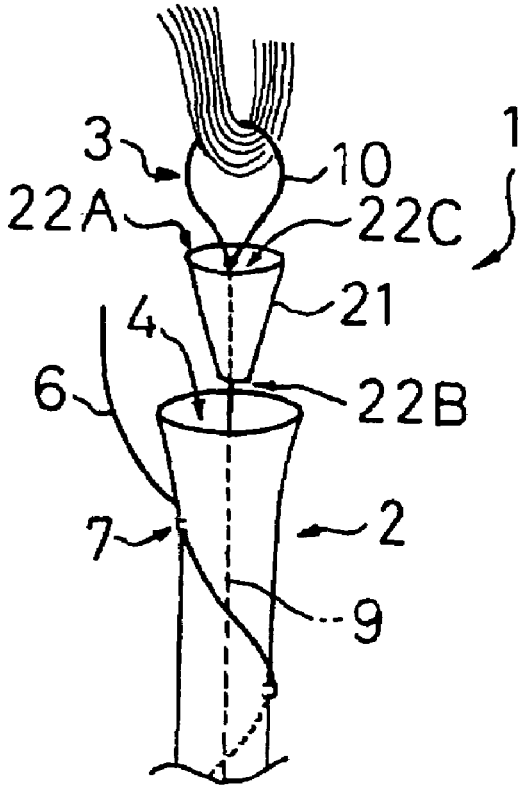
FIG. 6 shows another embodiment of a hairdressing tool.

The hairdressing tool 1 composed of two members, the hair holder 2 and the hair inserter 3, as used in the above-described embodiments can be replaced with a hairdressing tool 1 composed of three members, i.e., a hair holder 2, a hair inserter 3, and an auxiliary inserting member 21 as shown in FIG. 6. The auxiliary inserting member 21 has an inverted cone shape and is made of a rigid material. To improve smoothness of hair insertion, it is particularly preferred that the auxiliary inserting member 21 be made of a material more rigid than the material of the hair holder 2. The auxiliary inserting member 21 has an inlet 22A, an outlet 22B, and a passageway 22C connecting the inlet 22A and the outlet 22B in the longitudinal direction thereof. The diameter of the passageway 22C decreases continuously from the inlet 22A to the outlet 22B. The diameter of the inlet 22A is smaller than that of the narrowest part of the hair holder 2. The pulling member 9 of the hair inserter 3 passes through the passageway 22C from the inlet 22A to the outlet 22B and then enters the hair holder 2 through the hair inlet 4. The hairdressing tool 1 according to this embodiment is advantageous in that hair can be inserted smoothly even when the hair inlet 4 of the hair holder 2 has low rigidity. Additionally, the auxiliary inserting member 21 expands the tube of the hair holder 2 which is liable to become flat when hair is inserted into the hair holder with the hair inserter 3, thereby improving the ease of hair insertion. The shape of the auxiliary inserting member 21 includes not only the inverted cone but various inverted pyramidal shapes.

In a modification of the hairdressing tool 1 according to the embodiment shown in FIG. 6, the auxiliary inserting member 21 may have a larger diameter at the inlet 22A than the hair inlet 4 of the hair holder 2. According to this modified embodiment, the auxiliary inserting member 21 is restrained by the hair inlet 4 from entering the hair holder 2 and stopped at the hair inlet 4 when hair is pulled into the hair holder 2 by the hair inserter 3. In this case, too, the auxiliary inserting member 21 brings about improved smoothness of hair insertion.

Figure 7A:
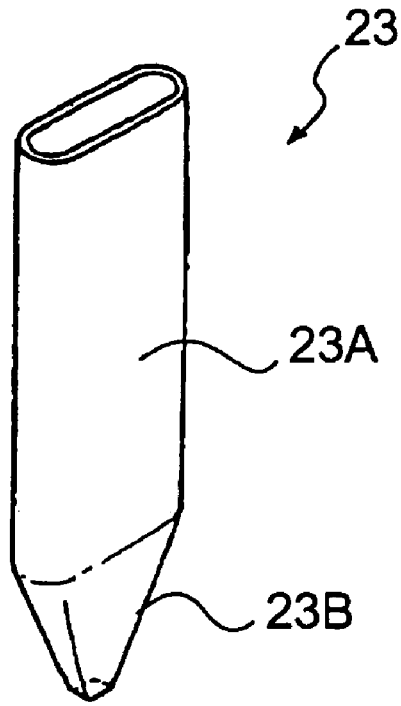
FIG. 7 shows another embodiment of an auxiliary inserting member.
Figure 7B:
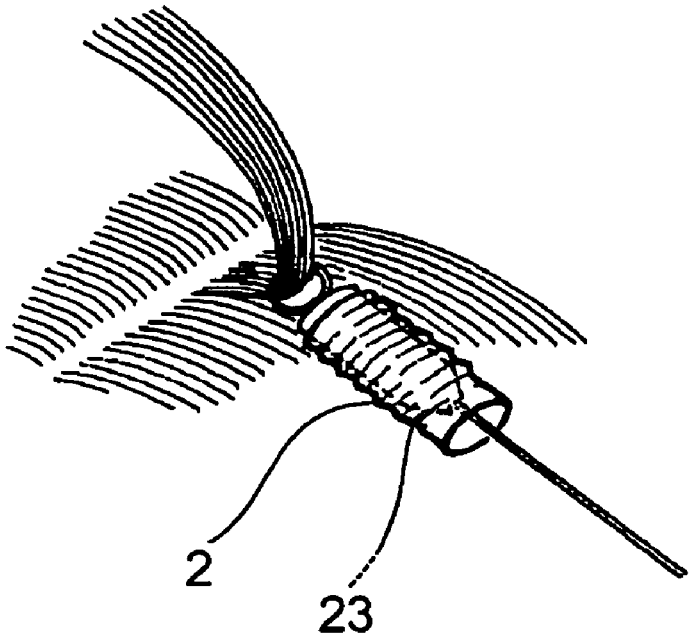
Figure 8A:
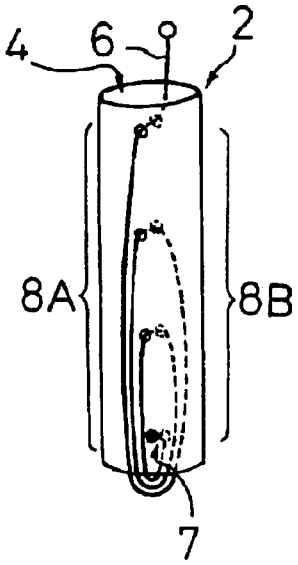
FIG. 8(*a*), FIG. 8(*b*), and FIG. 8(*c*) show another embodiment of a hair holder.
Figure 8B:
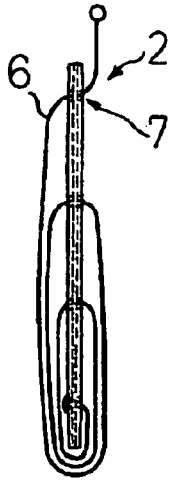
Figure 8C:
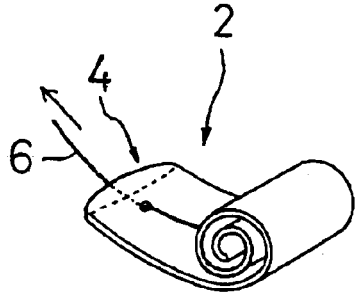

In another modification of the hairdressing tool 1 according to the embodiment of FIG. 6, an auxiliary inserting member 23 shown in FIG. 7(*a*) can be used. The auxiliary inserting member 23 shown in FIG. 7(*a*) is made of plastic and has a slender and flattened shape with an opening at both ends. The auxiliary inserting member 23 has an elliptic cross-section and is composed of a tubular part 23A with an opening at both ends and a tapered part 23B which is connected to the lower opening of the tubular part 23A and narrows toward the tip. The tip of the tapered part 23B, i.e., the lower end of the auxiliary inserting member 21 is open. The length, cross-sectional contour, and cross-sectional area of the tubular part 23A are designed so that the hair holder 2 may be immovably fitted over the auxiliary inserting member 23 by the frictional force of the outer surface of the tubular part 23A when the auxiliary inserting member 23 is inserted into the hair holder 2 as illustrated in FIG. 7(*b*). Fixed by the auxiliary inserting member 23 owing to this design, the hair holder 2, even if not held by hand, does not fall off only if a user holds the auxiliary inserting member 23 in the hand. As a result, the step of inserting hair can be carried out more easily. The presence of the tubular part 23A further improves smoothness of hair insertion.

Hair holders 2 shown in FIGS. 8 through 17 are also useful. In FIGS. 8 to 17 the hair inserter is not illustrated for the sake of simplicity. The description with respect to the foregoing embodiments appropriately applies to the particulars of the embodiments shown in FIGS. 8 to 17 that are not explained here. When seen from the front, the hair holder 2 shown in FIGS. 8(*a*) to 8(*c*) has holes arranged at a given interval in the longitudinal direction to make a first line 8A and holes arranged at positions opposite to those of the first line 8A to make a second line 8B. Unlike the through-holes of the hair holder shown in FIG. 1, each of the holes of the present embodiment is a single eyelet. The tailing end of the curling thread 6 is designed not to be unthreaded through the hole 7 which is in the first line 8A and the nearest to the lower end of the hair holder 2 (this hole will be called the lowest hole in the first line). Specifically, the tailing end of the curling thread 6 is fixed to the hair holder 2 near the lowest hole in the first line so as not to be pulled out.

The other end of the curling thread 6 threaded through the lowest hole in the first line is then threaded through the hole which is in the second line 8B and opposite to the lowest hole of the first line. The end coming out of that hole goes round the lower end of the hair holder 2 and passes through the hole right above the lowest hole of the first line 8A and then the opposite hole of the line 8B. The curling thread 6 is threaded in this manner a desired number of times. Finally, the other end of the curling thread 6 passes through the hole 7 of the second line 8B.

Hairdressing using the hairdressing tool 1 with the hair holder 2 according to the present embodiment is carried out as follows. A strand of hair is inserted in the hair holder 2 with the hair inserter. The free end of the curling thread 6 is pulled either before or after a hair treating agent is applied. Whereupon, the hair holder 2 having the hair (not shown) therein is rolled up in the pulling direction of the curling thread 6, i.e., from its lower end toward the hair inlet 4. The root of the curling thread 6 emerging from the hair holder 2 is fixed with a clip (not shown) to keep the rolled state.

According to the present embodiment, hair can be rolled up into the same shape as with a curling rod. Thus, rolling hair onto a curling rod, which is usually done in a beauty parlor, is unnecessary. While the embodiment shown in FIGS. 8(*a*) to 8(*c*) uses a single curling thread 6, two curling threads may be used to facilitate and secure the rolling operation. In that case, each curling thread is threaded in the same manner as described above through holes arranged on both longer sides of the hair holder 2 when the hair holder 2 is viewed from the front.

Figure 9A:
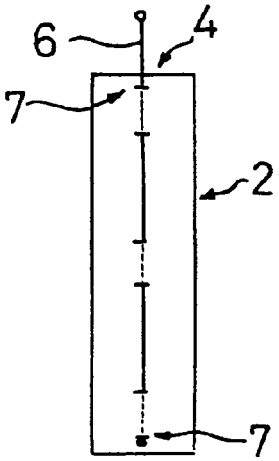
FIG. 9(*a*), FIG. 9(*b*), and FIG. 9(*c*) show other embodiments of a hair holder.
Figure 9B:
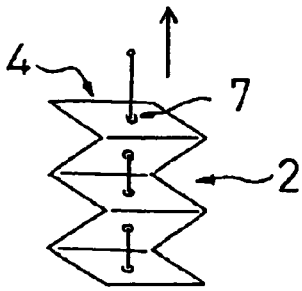
Figure 9C:
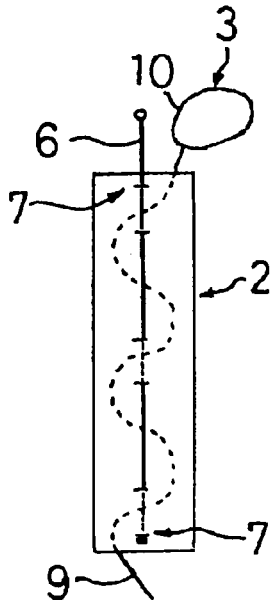

The hair holder 2 shown in FIGS. 9(*a*) and 9(*b*) has the curling thread 6 threaded therethrough to work a line of running stitches in the longitudinal direction of the hair holder 2. In detail, when the hair holder 2 is seen from the front, the curling thread 6 passes through the hair holder 2 from front to back and from back to front alternately. The tailing end of the curling thread 6 is designed not to be unthreaded through the hole 7 provided near the lower end of the hair holder 2. Specifically, the end of the curling thread 6 is fixed to the hair holder 2 near the lower end of the hair holder 2 so as not to be pulled out. The leading end of the curling thread 6 emerges from the nearest hole 7 to the hair inlet 4 remains free. The pulling member (not shown) of the hair inserter is inserted straight into the hair holder 2.

Hairdressing using the hairdressing tool having the hair holder 2 according to the present embodiment is carried out as follows. On pulling the free end of the curling thread 6 threaded through the hair holder 2, the hair holder 2 is accordion-folded together with hair (not shown) contained therein, and the hair is bent in a zig zag form. The root of the curling thread 6 coming out of the hair holder 2 is fixed with a clip (not shown) to keep the bent form.

Where the pulling member of the hair inserter 3 winds through the inside of the hair holder 2 in and out among the stitches of the curling thread 6 as shown in FIG. 9(*c*), pulling the free end of the curling thread 6 rolls up the hair holder 2 not in an accordion but helical form.

Figure 10A:
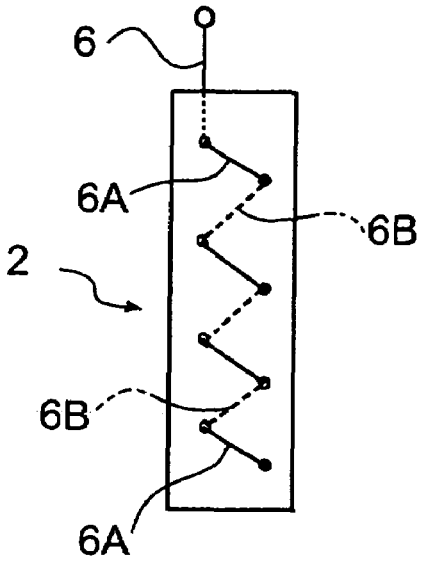
FIG. 10(*a*) and FIG. 10(*b*) show another embodiment of a hair holder.
Figure 10B:
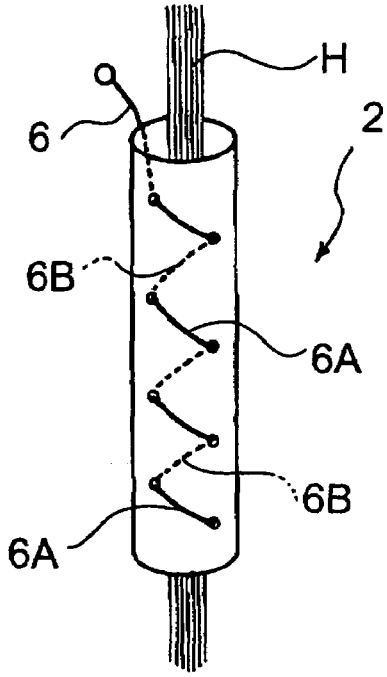

In the embodiment shown in FIGS. 10(*a*) and 10(*b*), when the hair holder 2 is in a flattened state, the curling thread 6 is disposed to depict a zig zag trace along the longitudinal direction of the hair holder 2 as shown in FIG. 10(*a*). The zig zag trace is alternately composed of first traces 6A sloping upward from right to left and second traces 6B sloping upward from left to right. The parts of the curling thread 6 depicting the first traces 6A are disposed on the outer surface on the front side of the flattened hair holder 2, while the parts depicting the second traces 6B are on the outer surface on the back side of the flattened hair holder 2. Both ends of the individual first traces 6A pierce the hair holder 2 and emerge from the back side of the hair holder 2 and connect to the ends of the second traces 6B. On the other hand, both ends of the individual second traces 6B pierce the hair holder 2 and emerge from the front side of the hair holder 2 and connect to the ends of the first traces 6A. With the hair holder 2 in this flattened state being inflated into a cylindrical shape as illustrated in FIG. 10(*b*), the curling thread 6 is as if it is helically wound around the hair holder 2, except that the curling thread 6 passes inside the hair holder 2 when it pierces the hair holder 2.

The hair holder 2 according to the present embodiment is used as follows. A hair inserter (not shown) is previously inserted inside the helix of the curling thread 6. A strand of hair H is inserted according to the above-mentioned procedure and thereby passed through the inside of the helix of the curling thread 6 as shown in FIG. 10(*b*). On pulling the curling thread 6, the hair is rolled up into a polygonal shape, e.g., a triangle or a hexagon, when viewed with the pulling direction as an axis. What polygonal shape the hair is rolled in depends on the slope and the length of the first traces 6A and the second traces 6B around the hair holder 2.

Figure 11A:
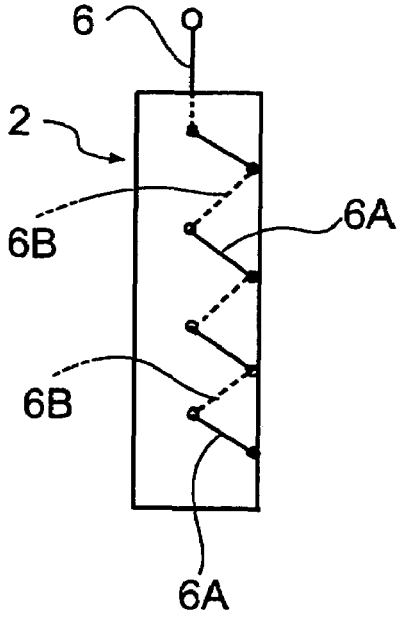
FIG. 11(*a*) and FIG. 11(*b*) show another embodiment of a hair holder.
Figure 11B:
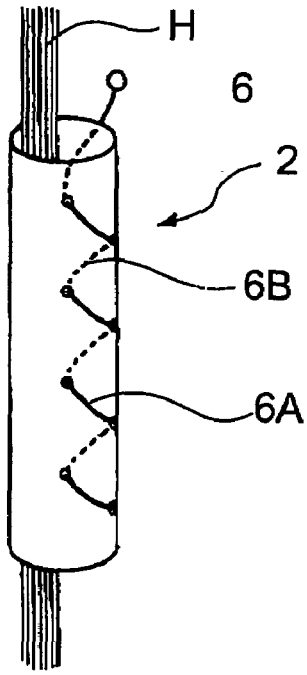

In the hair holder 2 of the embodiment shown in FIGS. 11(*a*) and 11(*b*), the way of threading the curling thread 6 is the same as in FIGS. 10(*a*) and 10(*b*). The difference between the two embodiments is that, while the curling thread 6 of FIGS. 10(*a*) and 10(*b*) is threaded symmetrically about the longitudinal centerline of the hair holder 2, the horizontal position of the curling thread 6 of FIGS. 11(*a*) and 11(*b*) is shifted to the right of the longitudinal centerline of the hair holder 2. The hair holder 2 in that flattened state being inflated into a cylindrical shape as shown in FIG. 11(*b*), the curling thread 6 comes to be wound helically on the outer surface of the longitudinal half of the hair holder 2, except that the curling thread 6 passed inside the hair holder 2 when it pierces the hair holder 2.

The hair holder 2 of this embodiment is used as follows. A hair inserter (not shown) is passed through the part of the hair holder 2 where the curling thread 6 is not threaded, that is, the longitudinal half on the left of the longitudinal centerline of the hair holder 2. Then, a strand of hair is inserted in the same manner as described previously and passed by the helix formed of the curling thread 6 as shown in FIG. 11(*b*). On pulling the curling thread 6, the hair is rolled up into a ring when seen with the thread pulling direction as an axis. The hair can be rolled into a polygonal shape, such as a triangle or a hexagon, which depends on the slope of the first traces 6A and the second traces 6B shown in FIG. 11(*a*). Use of the hair holder according to the present embodiment presents an advantage that hair gets set just like as with a curling rod.

In the present embodiment, the part of the hair holder 2 where the curling thread 6 is threaded, i.e., the part on the right hand side of the longitudinal centerline can be made harder than the rest of the hair holder 2 where the curling thread is absence, i.e., the part on the left hand side, whereby the rolling operation can be done more smoothly. For the same purpose, the part of the hair holder 2 where the curling thread 6 is absence, i.e., the part on the left of the longitudinal centerline of the hair holder 2 can be made of an extensible material.

Figure 12A:
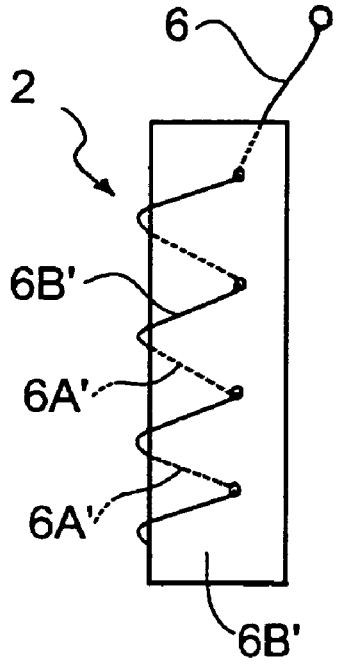
FIG. 12(*a*) and FIG. 12(*b*) show another embodiment of a hair holder.
Figure 12B:
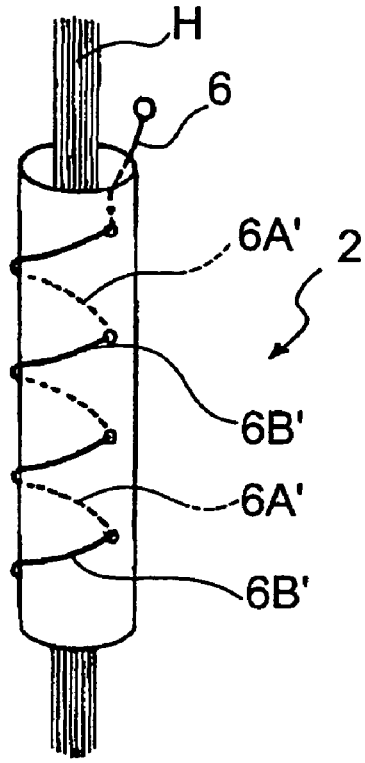

Seen in the flattened state, the hair holder 2 shown in FIGS. 12(*a*) and 12(*b*) has the curling thread 6 provided to depict a zig zag trace along the longitudinal direction of the hair holder 2. The zig zag trace is alternately composed of first traces 6A' sloping upward from right to left and second traces 6B' sloping upward from left to right. The parts of the curling thread 6 depicting the first traces 6A' are disposed on the back side of the flattened hair holder 2, while the parts depicting the second traces 6B' are on the front side.

The lower end of the individual first traces 6A' pierces the hair holder 2 and emerges from the front side and connects to the upper end of the respective second traces 6B'. The upper end of the individual first traces 6A' connects to the lower end of the respective second traces 6B' at a position slightly apart from one longer side of the hair holder 2. On the other hand, the upper end of the individual second traces 6B' pierces the hair holder 2 and emerges from the back side and connects to the lower end of the respective first traces 6A'. The lower ends of the individual second traces 6B' connects to the upper end of the respective first traces 6A' at a position slightly apart from the longer side of the hair holder 2.

With the hair holder 2 in the flattened state being inflated into a cylindrical shape as illustrated in FIG. 12(*b*), the curling thread 6 comes to be wound around the hair holder 2 substantially helically, except that the curling thread 6 passes inside the hair holder 2 when it pierces the hair holder 2; The hair holder 2 according to the present embodiment is used as follows. A hair inserter (not shown) is previously inserted inside the helix of the curling thread 6. A strand of hair is inserted according to the above-mentioned procedure and thereby passed through the inside of the helix of the curling thread 6 as shown in FIG. 12(*b*). On pulling the curling thread 6, the hair is rolled up into the same shape as in the embodiment shown in FIG. 8(*c*). Use of the hair holder according to the present embodiment presents an advantage that hair gets set just like as with a curling rod.

Figure 13A:
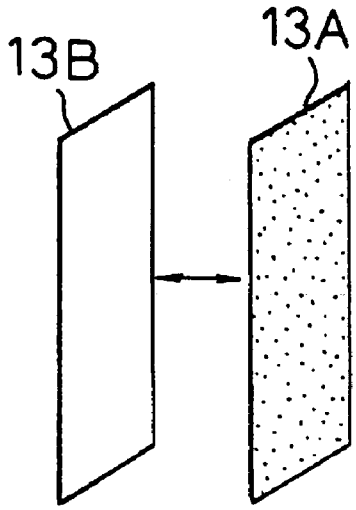
FIG. 13(*a*), FIG. 13(*b*), and FIG. 13(*c*) show another embodiment of a hair holder.
Figure 13B:
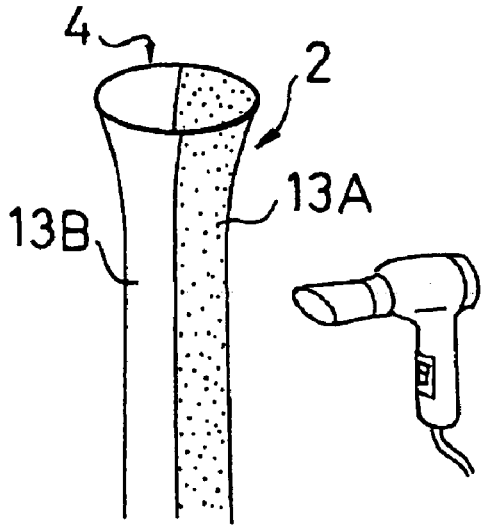
Figure 13C:
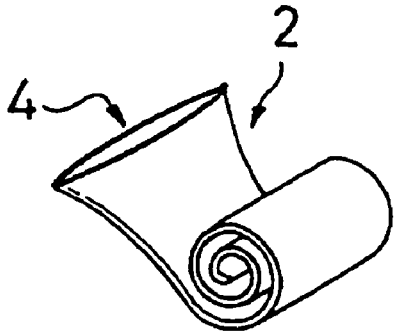

The hair holder 2 shown in FIGS. 13(*a*) through 13(*c*) is composed of two sheets, a first sheet 13A and a second sheet 113B, both strip-shaped, which are superposed on each other and joined along both longer sides to make a tube. The two sheets are equal in shape and size. One of the sheets, the first sheet 13A, has heat shrinkability whereas the other sheet, the second sheet 13B, does not. Hairdressing with the hairdressing tool comprising the hair holder according to this embodiment is performed as follows. A strand of hair is inserted into the hair holder 2 by means of a hair inserter, and heat is applied to the hair holder 2 as illustrated in FIG. 13(*b*) either before or after a hair treating agent is applied. Heat application is conveniently achieved with, for example, a hair drier. On heat application, the first sheet 13A of the two sheets composing the hair holder 2 shrinks, whereas the other sheet, the second sheet 13B, does not. As a result of the difference in shrinkage, the hair holder 2 rolls up together with the hair contained therein with the side of the first sheet 13A inward as shown in FIG. 13(*c*). This rolled state is retained even after heat application to the hair holder 2 is stopped. Thus, the hair holder according to the present embodiment is advantageous in that means for keeping the curled state is unnecessary unlike the hair holders of the aforementioned embodiments. Although the tubular hair holder 2 of the present embodiment is made up of two strip-shaped sheets, it is possible to make the tubular hair holder by joining three or more strip-shaped sheets at their longer sides. In this case, at least one of the sheets is shrinkable with the other(s) being non-heat shrinkable. The heat shrinkable sheet serves as a curling member of the hair holder.

Figure 14:
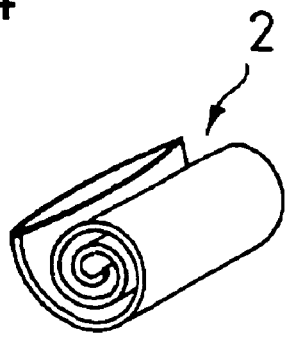
FIG. 14 shows another embodiment of a hair holder.

The hair holder 2 shown in FIG. 14 is made of a rectangular sheet shaped into a tube longer than is wide, rolled up, and set in the rolled state by prescribed means. When the hair holder 2 is unrolled in the longitudinal direction and then let free, it spontaneously rolls to restore its rolled state. In order to set the hair holder into a roll shape, it is convenient to use an elastically deformable material cut to shape and size. The elastically deformable material includes polyethylene terephthalate, polypropylene, polystyrene, and polyacrylonitrile. The hair holder 2 made of such an elastically deformable material can be set into a roll by rolling up the hair holder 2, fixing the rolled state by certain means, and heating the roll of the hair holder 2 to a prescribed temperature. Hairdressing using the hairdressing tool having the hair holder 2 of the present embodiment is carried out as follows. After a strand of hair is inserted in the hair holder 2 with a hair inserter, the hair holder in an unrolled state is let free, whereby it rolls up spontaneously. Therefore, the hair holder of the present embodiment needs no rolling operation. The hair holder of the present embodiment has another advantage that means for maintaining the rolled state is unnecessary similarly to the hair holder shown in FIGS. 13(*a*) to 13(*c*). The shape in which the hair holder 2 is curled is not limited to a roll as in the above-mentioned particular example and includes various shapes, such as an accordion-folded shape, a zig zag shape, and a helical shape, according to the purpose.

Figure 15:
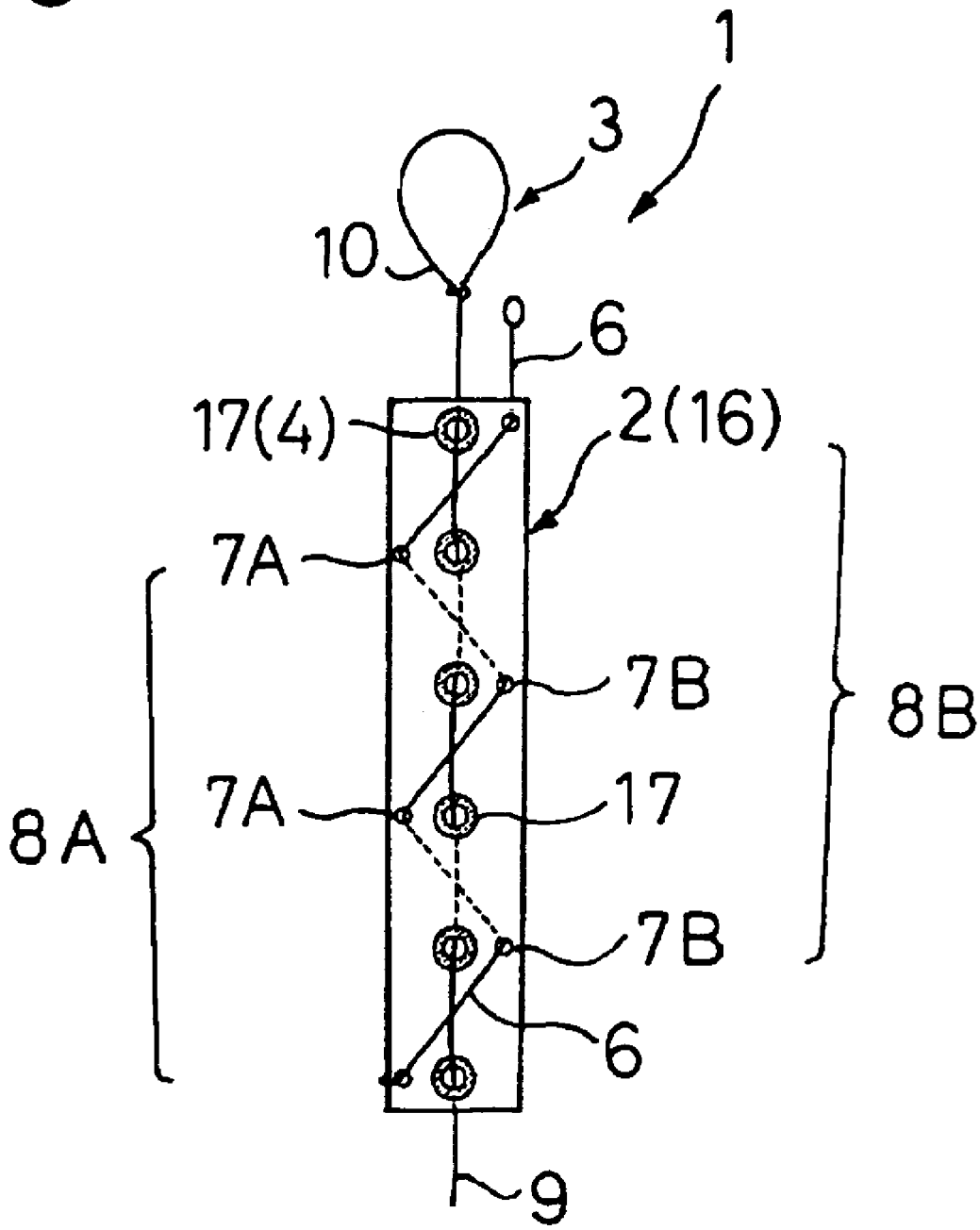
FIG. 15 shows another embodiment of a hair holder.
Figure 16:
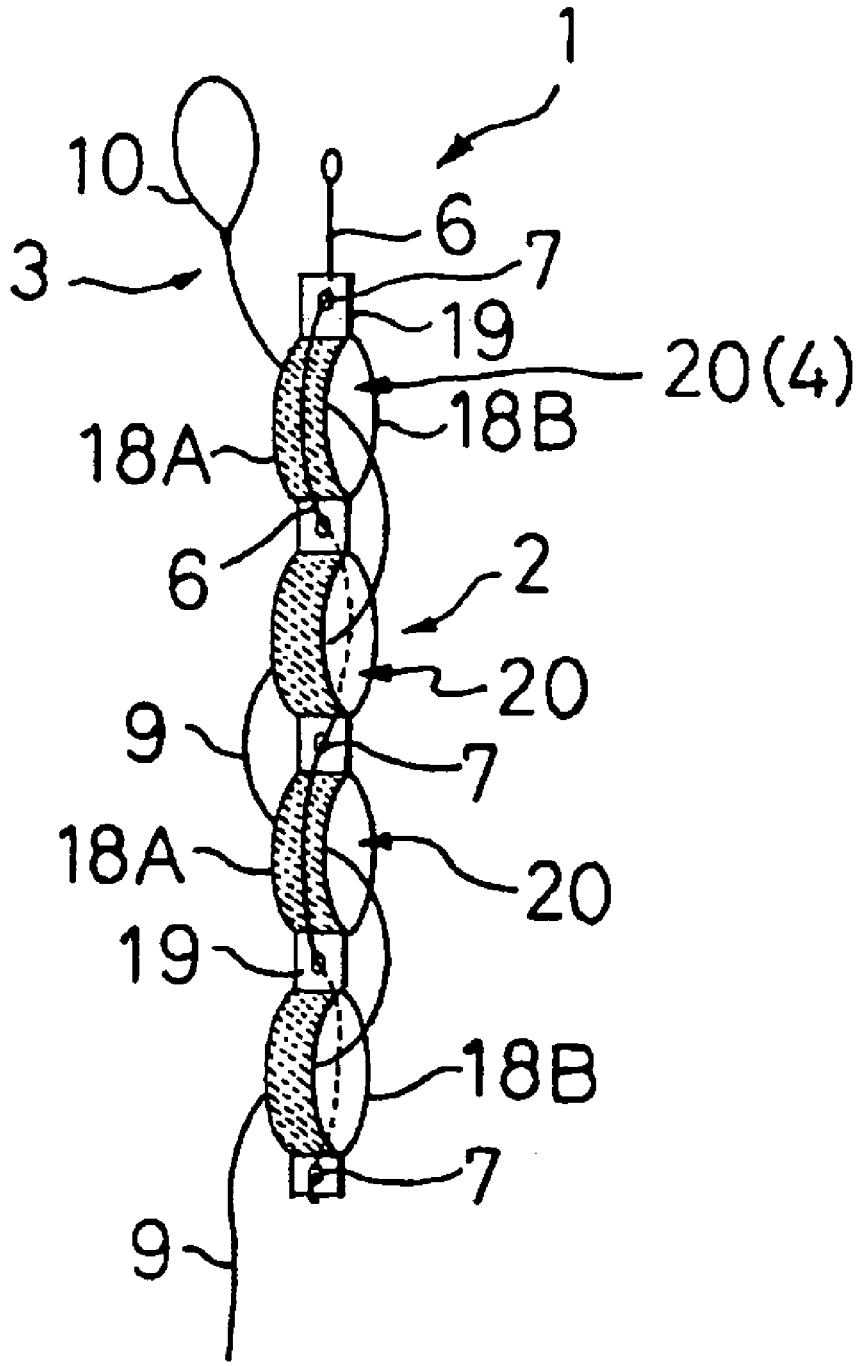
FIG. 16 shows another embodiment of a hair holder.

The hair holders of the hairdressing tool 1 according to the embodiments shown in FIGS. 15 and 16 are not tubular unlike those described hereinbefore. In detail, the hairdressing tool 1 shown in FIG. 15 comprises a strip-shaped sheet 16 as a hair holder 2 and a curling thread 6 as a curling member combined with the hair holder 2. The strip-shaped sheet 16 has openings 17 each serving as a hair inlet 4 on the longitudinal centerline thereof at a given interval. The periphery of each opening 17 is made harder than the other part of the hair holder 2 by adhering a plastic sheet or paperboard thereto. Where the hair holder 2 is formed of thermoplastic resin-made nonwoven fabric, the edges of the opening 17 can be heat melted followed by solidification to become harder. The strip-shaped sheet 16 has a line of holes 7A along one longer side thereof at a given interval (hereinafter referred to as a first line 8A) and a line of holes 7B along the other long side thereof at a given interval (hereinafter referred to as a second line 8B). The longitudinal position of each of the holes 7B of the second line 8A is between the holes 7A of the first line 8A. Specifically, each hole 7B is positioned at the middle between two adjacent holes 7A. The tailing end of the curling thread 6 is fixed at the position of the hole 7A, of the first line 8A, nearest to the lower end of the hair holder 2. Starting from that hole 7A, the other end, i.e., the leading end threads its way alternately through the holes 7B of the second line 8B and the holes 7A of the first line 8A in that order. It finally passes through the hole 7B of the second line 8B. Thus, the curling thread 6 alternately appears on the front and back surfaces of the strip-shaped sheet 16, depicting a triangular wave form extending in the longitudinal direction of the hair holder 2.

The hair inserter 3 of the hairdressing tool 1 is attached to the strip-shaped sheet 16 with its pulling member 9 piercing the strip-shaped sheet 16 as if to make running stitches. Specifically, the pulling member 9 of the hair inserter 3 is threaded through the openings 17, appearing alternately on the front and back surfaces of the strip-shaped sheet 16.

Hairdressing using the hairdressing tool 1 according to this embodiment is carried out as follows. A strand of hair is caught on the hair catching member 10 of the hair inserter 3. As the pulling member 9 is pulled, the hair is successively threaded through the openings 17 so as to emerge alternately on the front and back surfaces of the strip-shaped sheet 16. In this state, the free end of the curling thread 6 attached to the hair holder 2 is pulled. It follows that the hair holder 2 is rolled up together with the hair in a helical or accordion form. The root of the curling thread 6 emerging from the hair holder 2 is fixed with a clip (not shown) to maintain the rolled state.

The hair holder 2 of the hairdressing tool 1 shown in FIG. 16 is composed of a first sheet 18A and a second sheet 18B, both of which are narrow strips. The sheets 18A and 18B are bonded together at a given longitudinal interval to alternately make joints 19 and rings 20. The rings 20 serve as hair inlets 4. Each joint 19 has a hole 7 for insertion. The rings 20 are made harder than the other part of the hair holder 2 by adhering a sheet of plastic or paperboard. The hair holder 2 also has a curling thread 6 as a curling member. The curling thread 6 is successively threaded through the holes 7 so as to appear alternately on the side of the first sheet 18A and the side of the second sheet 18B. The tailing end of the curling thread 6 is fixed at the hole 7 positioned at the lower end of the hair holder 2. The other end of the curling thread 6 emerging from the hole 2 positioned at the upper end of the hair holder 2 remains free.

The hair inserter 3 of the hairdressing tool 1 has its pulling member 9 successively threaded through the rings 20 as if to make running stitches.

In carrying out hairdressing with the hairdressing tool 1 according to the present embodiment, a strand of hair is caught on the hair catching member 10 of the hair inserter 3 and threaded through the rings 20 as if to work running stitches by pulling the pulling member 9. In this state, the free end of the curling thread 6 attached to the hair holder 2 is pulled. As a result, the hair holder 2 is accordion-folded together with the hair, and the hair is thus bent zig-zag or helically. The root of the curling thread 6 emerging from the hair holder 2 is fixed with a clip (not shown) to maintain the bent state.

Figure 17A:
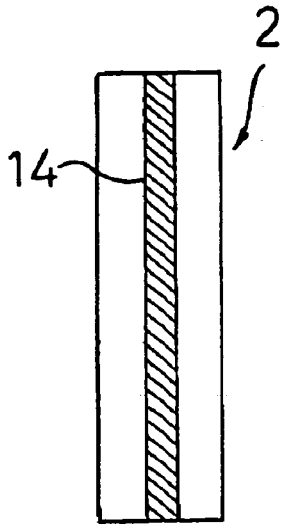
FIG. 17 shows another embodiment of a hair holder.
Figure 17B:
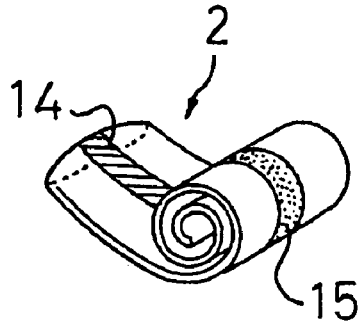

The hair holder 2 according to the embodiment shown in FIGS. 17(*a*) and 17(*b*) has means for maintaining its rolled state. For the sake of simplicity, illustration of the hair inserter and the curling member is omitted from FIGS. 17(*a*) and 17(*b*). The hair holder 2 has a first side (front side) and a second side (back side) opposite to the first side. A joining member is provided on the front side. When the hair holder 2 is rolled, curved or bent into a prescribed shape with its back side in contact with the front side, the joining member joins the front side and the back side thereby to maintain the prescribed shape of the hair holder 2. Specifically, with the hair holder 2 seen from the front, an engaging member 14 is provided on the front side along the longitudinal centerline, and an engageable member 15 is provided on the back side at a position directly opposite to the engaging member 14. The engaging member 14 and the engageable member 15 both extend in the longitudinal direction of the hair holder 2. The engaging member 14 and the engageable member 15 are typically exemplified by hooks and loops to make a surface fastening system. When the hair holder 2 is rolled up with its front side inward, the engaging member 14 functions as a joining member capable of joining the back side to the front side thereby to maintain the shape of the roll. In detail, after a strand of hair is inserted into the hair holder 2 with a hair inserter (not shown), the hair holder 2 is rolled from its lower end toward the hair inlet by means of a curling member (not shown). Whereupon the engaging member 14 provided on the front side and the engageable member 15 provided on the back side are brought into contact and engaged to each other as shown in FIG. 17(*b*). That is, the front and back sides of the hair holder 2 are joined together. As a result, the hair holder 2 is maintained in its rolled state.

In a modification of the embodiment shown in FIGS. 17(*a*) and 17(*b*), the engaging member 14 and the engageable member 15 can be replaced with self-adhesive tapes (e.g., Fushigi Tape (trade name) of Nirei Industry Co., Ltd.). In another modification, a double sided adhesive tape can be adhered to the front side of the hair holder 2 in the longitudinal direction. In other words, this modification corresponds to the embodiment of FIGS. 17(*a*) and 17(*b*) in which the engaging member 14 is replaced with a double sided adhesive tape, and the engageable member 15 is not provided. The double sided tape functions as a joining member for joining the front side and the back side of the hair holder 2. According to this modified embodiment, a material for joining can be saved by the amount of the engageable member 15 compared with the hair holder 2 of embodiment shown in FIGS. 17(*a*) and 17(*b*). While the hair holder 2 is rolled up in the example presented here, the same effects are obtained where the hair holder 2 is curved or bent into a desired shape. While the joining in the above-described embodiment was between the front side and the back side of the hair holder, the front side may be joined to itself to make a desired shape.

As is apparent from the foregoing, the hair holder according to the present invention preferably includes slender tube types and types having a plurality of openings arranged at longitudinal intervals. With these hair holders a strand of hair can be taken and held securely, curled without suffering from directional disturbance, and maintained in a neatly curled form in a stable manner.

In some applications of the hairdressing tools according to the embodiments shown in FIGS. 1 through 17, the curling member is not required. Permanent straightening of hair is one of such applications. A hairdressing tool 1 corresponding to the embodiment shown in FIG. 1 but having no curling member includes:- a hairdressing tool which comprises a slender hair holder having a hair inlet at one end thereof and comprising a flexible material and a hair inserter having a hair catching member at the tip thereof and which is used with the hair inserter being held in the hair holder such that the hair catching member is disposed by the side of the hair inlet of the hair holder, wherein the hair inlet and the vicinity thereof are more rigid than the other part of the hair holder; and a hairdressing tool which comprises a slender hair holder having a hair inlet at one end thereof and a hair inserter having a hair catching member at the tip thereof and which is used with the hair inserter being held in the hair holder such that the hair catching member is disposed by the side of the hair inlet of the hair holder, wherein the hair catching member is a deformable loop of which the circumference is larger than that of the hair inlet.

A hairdressing tool 1 corresponding to the embodiment shown in FIG. 6 but having no curling member includes:- a hairdressing tool which comprises a slender hair holder having a hair inlet at one end thereof and a hair inserter having a long and narrow pulling member and a hair catching member attached to the tip of the pulling member and which is used with the hair inserter being held in the hair holder such that the hair catching member is disposed by the side of the hair inlet of the hair holder and that the pulling member passes through the hair inlet, wherein the hairdressing tool further comprises an auxiliary inserting member having an inlet, an outlet, and a passageway connecting the inlet and the outlet in the longitudinal direction thereof and narrowing from the inlet toward the outlet, the pulling member of the hair inserter passes through the passageway of the auxiliary inserting member from the inlet to outlet thereof and then through the hair inlet of the hair holder.

A hairdressing tool 1 corresponding to the embodiment shown in FIG. 17 but having no curling member includes:- a hairdressing tool which comprises a slender hair holder having a hair inlet at one end thereof and comprising a flexible material and a hair inserter having a hair catching member attached to the tip thereof and which is used with the hair inserter being held in the hair holder such that the hair catching member is disposed by the side of the hair inlet of the hair holder, wherein the hair holder has a first side and a second side opposite to the first side and is provided on the first side with a joining member capable of joining the first side to the second side or to itself when the hair holder is rolled up, curved or bent into a prescribed shape to bring the first side and the second side into contact thereby maintaining the prescribed shape.

Hairdressing methods using these hairdressing tools with no curling member include a method comprising catching a desired amount of hair on the hair catching member, pulling the hair inserter in the direction of from the hair inlet, which is one end of the hair holder, toward the other end, and feeding a hair treating agent into the hair holder from the hair inlet or applying a hair treating agent to the hair holder.

FIGS. 18 through 22 schematically show other embodiments of a hair holder. In these drawings, a hair inserter and a curling member are not illustrated for the sake of simplicity. The hair holder 200 shown in FIG. 18 comprises a tube 212 made of a sheet 223 and is configured to have a strand of hair inserted therein from an opening 221 at one end toward an opening 222 at the other end. The tube 212 has substantially no extensibility in the longitudinal direction. The sheet 223 forming the whole circumference of the tube 212 has a Taber stiffness of 0.4 mN·m or less over the total length of the tube 212.

Figure 18:
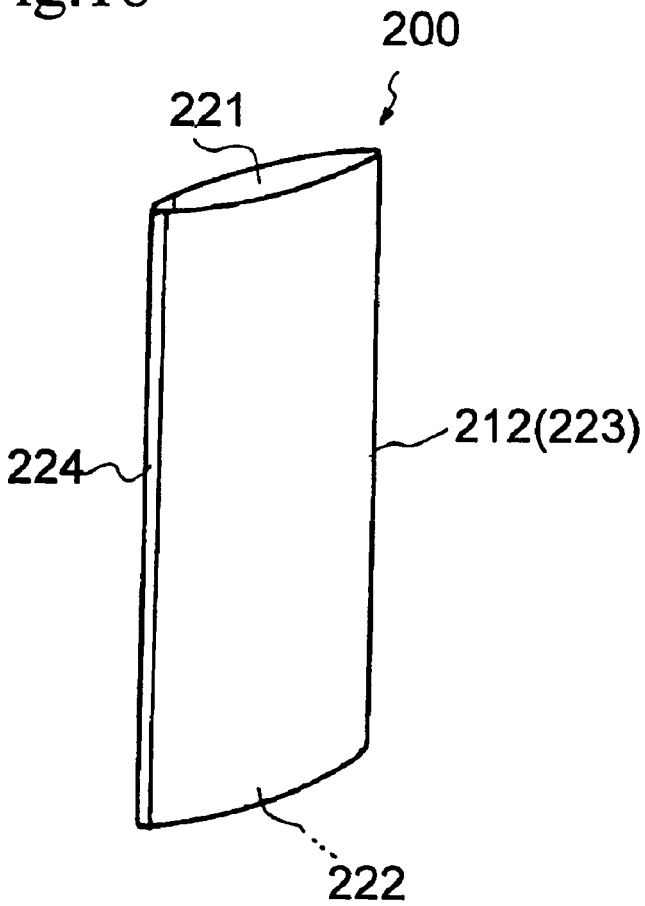
FIG. 18 shows another embodiment of a hair holder.

The tube 212 of the hair holder 200 is a flat tube having two walls. The cross-section of each wall is a straight line. For the sake of convenience, the tube 212 depicted in FIG. 18 is in a state widened to become a flat cylinder whose openings have the shape of a convex lens composed of two arched sides. Each of the two sides has a Taber stiffness of 0.4 mN·m or less, preferably 0.3 mN·m or less. If the sheet 223 has a Taber stiffness exceeding 0.4 mN·m, the tube 212 having a strand of hair inserted therein cannot be rolled smoothly, failing to curl the hair beautifully. The Taber stiffness is measured in accordance with the stiffness testing method specified in JIS P8125.

As stated, the tube 212 of the hair holder 200 has substantially no extensibility in the longitudinal direction (the vertical direction in FIG. 18). If the tube 212 exhibits extensibility in the longitudinal direction, the holder changes in dimension easily. It tends to follow that the tips of the hair are bent backward or irregularly curved while or after a strand of hair is inserted through the tube 212. The expression "substantially no extensibility in the longitudinal direction" means that the tube exhibits no extensibility in the longitudinal direction but may have an extension within a range of elastic deformation to such a degree as not to cause hair to bend backward.

The tube 212 of the hair holder 200 is formed by folding a rectangular sheet 223 in half along its length and joining the longer sides 224 and 224 together. The size of the tube 212 is optional, depending on the length or location of hair to be curled and the amount of hair to be inserted.

Various flexible materials can be used as the sheet 223 which forms the tube 212 and has a Taber stiffness of 0.4 mN·m or less. Useful flexible materials include nonwoven fabrics (e.g., polyethylene nonwoven fabric and polyethylene terephthalate nonwoven fabric), woven fabrics, porous or non-porous resin films (e.g., polyethylene film and polyethylene terephthalate film), paper, polymer sheets, rubber sheets, resin meshes, and composites of these materials. In this particular embodiment, a nonwoven fabric having a Taber stiffness of 0.4 mN·m or less and exhibiting permeability to a hair treating agent for permanent waving is used. The thickness of the sheet 223 is not particularly limited as long as the Taber stiffness is 0.4 mN·m or less, but is preferably 5 μm to 500 μm. It is preferred that the sheet be uniform in Taber stiffness and thickness over the entire area thereof.

Figure 19:
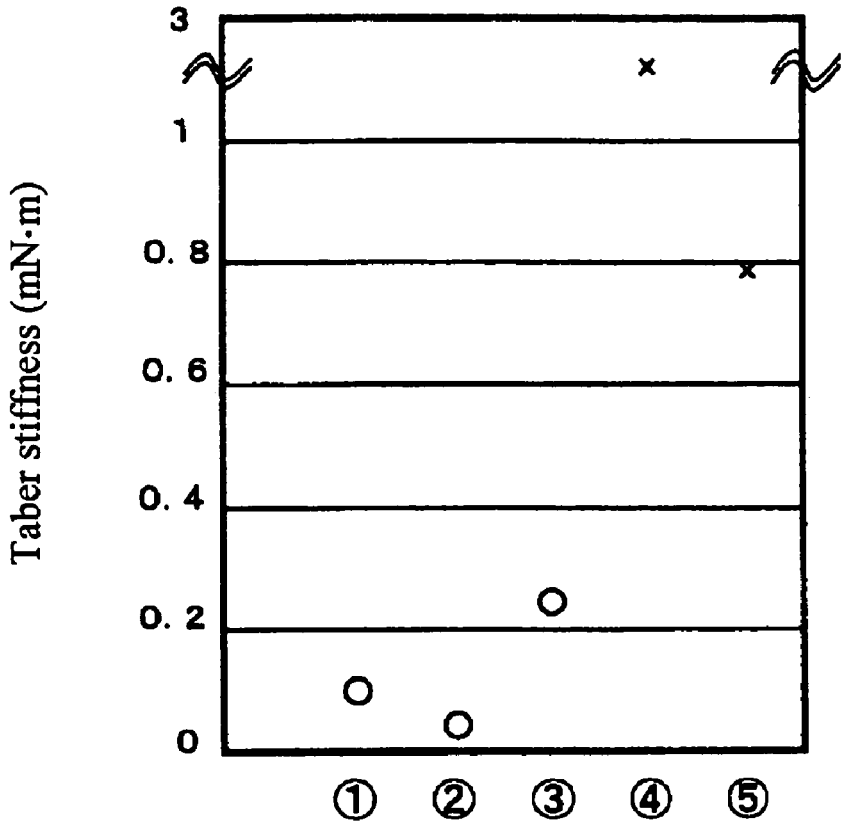
FIG. 19 is a graph showing the results of evaluation on tubes formed of various flexible materials.

FIG. 19 shows the results of evaluation on tubes formed of flexible materials (1) to (5) having different Taber stiffness values. All the tubes evaluated have the same configuration as the tube of the above-mentioned hair holder 200. The tubes formed of (1) polyethylene (PE) nonwoven fabric, (2) low-density polyethylene (LPDE) film, and (3) polyethylene terephthalate (PET) film, all of which have a Taber stiffness of 0.4 mN/m or less, were proved capable of rolling a strand of hair into a neat circle. By contrast, the tubes formed of (4) PET nonwoven fabric and (5) copying paper, both having a Taber stiffness more than 0.4 mN/m, failed to roll a strand of hair into a circle. Additionally, a tube formed of a latex glove, double stockings or a mesh bag for fruit were also evaluated to give the same results as with the tubes formed of the flexible materials (1) to (3).

Where the hair holder 200 of the present embodiment is used to roll a strand of hair, since the sheet 223 forming the tube 212 has a limited Taber stiffness, the tube 212 having a strand of hair inserted therein can be rolled up smoothly without being distorted. Having substantially no extensibility, the tube 212 does not extend while or after a strand of hair is inserted, hardly causing the hair to bend backward or the hair tips to get an irregular set. Thus, the hair holder 200 according to the present embodiment is capable of curling hair easily, surely, and neatly.

Figure 20:
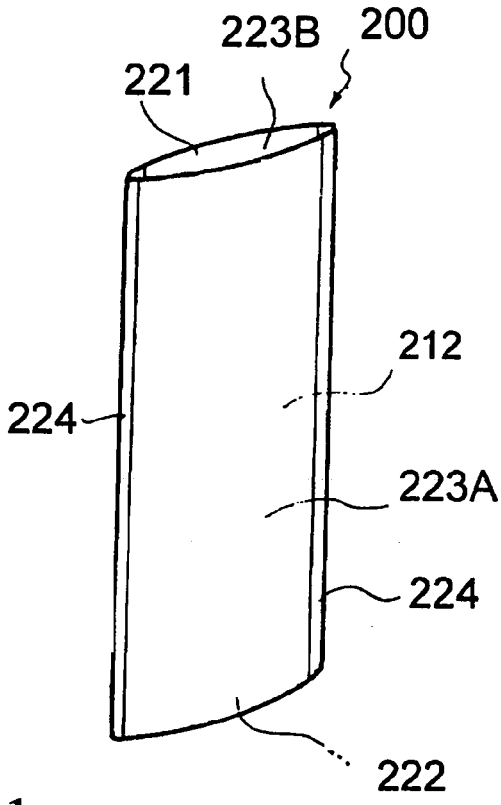
FIG. 20 shows another embodiment of a hair holder.

The tube 212 of the hair holder 200 shown in FIG. 20 is formed of two rectangular sheets 223A and 223B joined together along the longer sides 224 and 224. The sheet 223A, one of the two sheets, has a Taber stiffness of 0.4 mN·m or less. As long as the Taber stiffness of the sheet 223A, one of the sheets, is not more than 0.4 mN·m, that of the sheet 223B, the other sheet, may be either equal to or less than 0.4 mN·m or more than 0.4 mN·m. When the Taber stiffness of the sheet 223B exceeds 0.4 mN·m, a preferred upper limit is 20 mN·m. The sheet 223B used in the present embodiment has a Taber stiffness of 2 to 5 mN·m.

Similarly to the hair holder of the embodiment shown in FIG. 18, the hair holder 200 of the embodiment shown in FIG. 20 is capable of curling hair easily, surely, and neatly. When the hair holder 200 of the present embodiment is used to curl a strand of hair, it is preferably rolled with the sheet 223A of low Taber stiffness inward. In using a tube which is formed of extensible sheets but shows no extensibility as a whole, the tube can be rolled with either side inward.

Figure 21:
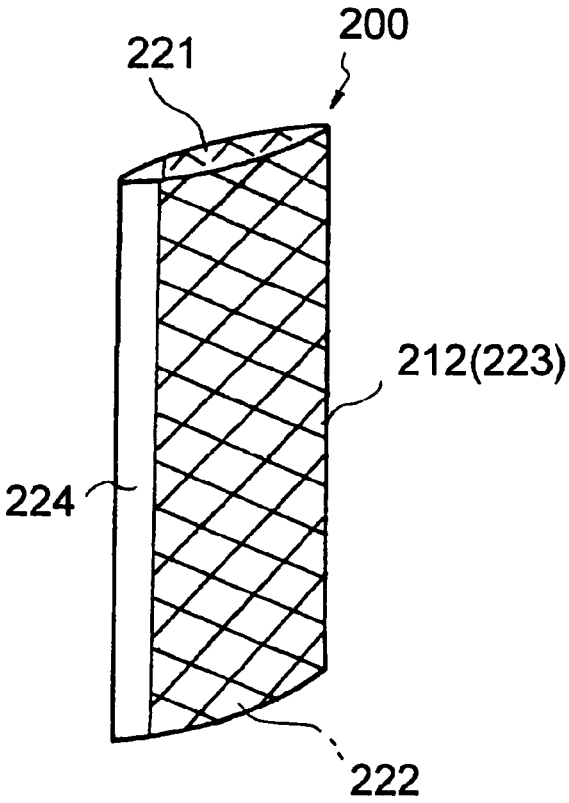
FIG. 21 shows another embodiment of a hair holder.

In the hair holder 200 according to the embodiment shown in FIG. 21, the tube 212 is formed by folding an extensible rectangular sheet 223 in half along its length and joining the longer sides 224 and 224 together. The joint along the longer side 224 exhibits no extensibility. The sheet 223 has a Taber stiffness of 0.4 mN·m or less over the whole length. The sheet 223 has a mesh structure of lattice pattern, which creates extensibility. Although the lattice mesh of the sheet 223 is oblique to the longitudinal direction of the tube 212, the tube 212 as a whole has substantially no extensibility because the side 224 lacks extensibility as stated. In the hair holder 200 of the present embodiment, the tube 212 exhibits extensibility in the width direction (horizontal direction in FIG. 21). With the extensibility of the tube 212 in the width direction, the opening 221 expands easily when a strand of hair is put therethrough, thereby facilitating insertion of the hair. Similarly to the hair holder of the embodiment shown in FIG. 18, the hair holder 200 according to the present embodiment is capable of curling hair easily, surely, and neatly.

Figure 22:
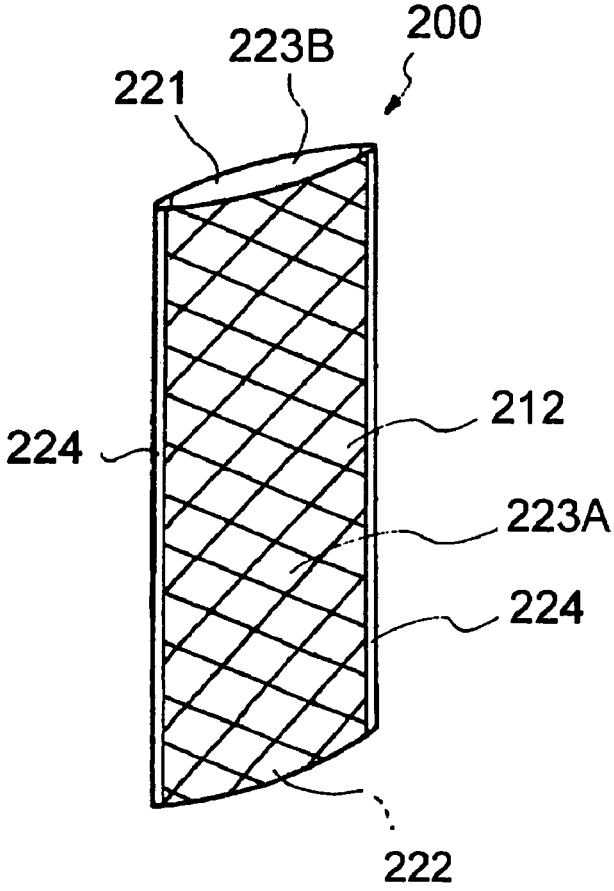
FIG. 22 shows another embodiment of a hair holder.

According to the embodiment shown in FIG. 22, the tube 212 of the hair holder 200 is fabricated of a rectangular sheet 223A having a mesh structure of lattice pattern and a rectangular sheet 223B with neither mesh nor holes, the two sheets 223A and 223B being bonded together at both the longer sides 224 and 224. The sheet 223A has longitudinal extensibility whereas the sheet 223B has substantially no longitudinal extensibility. Therefore, the tube 212 as a whole has substantially no extensibility. The sheet 223A has a Taber stiffness of 0.4 mN·m or less over the whole length, while the sheet 223B has a Taber stiffness of more than 0.4 mN·m over the whole length. According to this embodiment, the tube 212 of the hair holder 200 can be rolled up smoothly, with whichever of the sheets 223A and 223B inside, to curl hair easily, surely, and neatly.

Alterations, such as those described below, can be added to the hair holders of the embodiments shown in FIGS. 18 through 22. In the case of a flat tube, as long as a sheet whose Taber stiffness is 0.4 mN·m or less forms at least the part of the tube corresponding to half the circumference of the tube's cross-section, that sheet may be disposed over an area including one side and the other side of the flat tube. A flat tubular shape may be composed of two arched sides. As long as a tube has substantially no extensibility as a whole, part of the sheet(s) forming the tube may have extensibility. In the embodiment shown in FIG. 21, while the tube 212 is formed by folding an extensible sheet into two and joining the longitudinal sides together, the tube may be formed by joining two extensible sheets along their longer sides.

The tubes used in the hair holders of the embodiments shown in FIGS. 18 to 22 are not limited in method of fabrication. For instance, edges of a sheet or sheets are joined by sewing or fusion bonding or with an adhesive, or the tubes may be those obtained as an integral body by extrusion or like techniques. In the embodiments shown in FIGS. 18 and 20, nonwoven fabric permeable to a hair treating agent for a permanent wave is used as a sheet to fabricate the tube, but the present invention embraces embodiments in which a liquid impermeable sheet is used to fabricate a tube. The other opening of the tube can be made closable by providing a zipper along that opening. A plastically deformable member may be attached to the tube-forming sheet along the longitudinal direction. When a strand of hair is rolled in a hair holder with such a structure, the recovering force of the hair can be restrained. While the tubes of the embodiments shown in FIGS. 18 to 22 are open at both ends thereof, they may be designed to have one end left open and the other end closable with some means. It is possible to appropriately alter or combine different parts of the embodiments shown in FIGS. 18 to 22.

Figure 23:
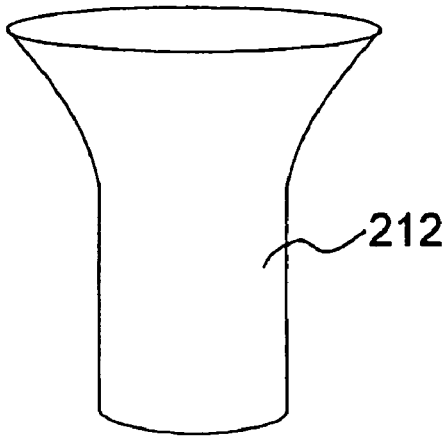
FIG. 23 shows another embodiment of a hair holder.
Figure 24A:
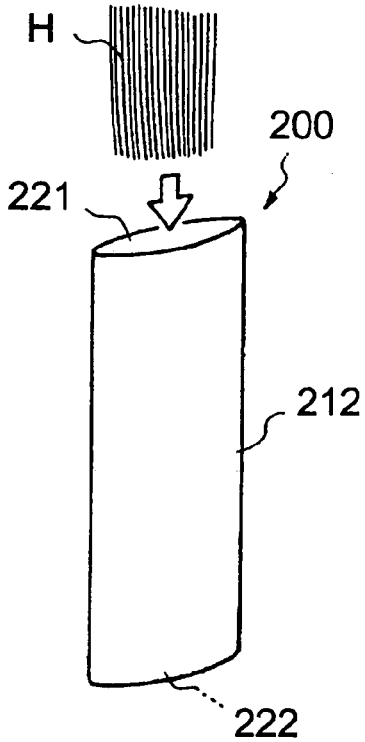
FIG. 24(*a*), FIG. 24(*b*), FIG. 24(*c*), and FIG. 24(*d*) present perspectives illustrating the procedure of rolling a strand of hair with a hair holder having no curling member.
Figure 24B:
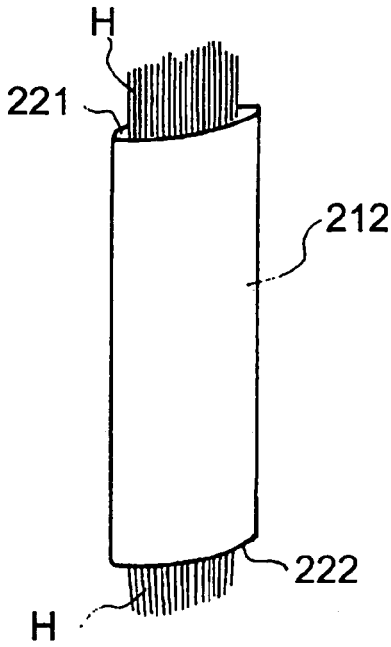
Figure 24C:
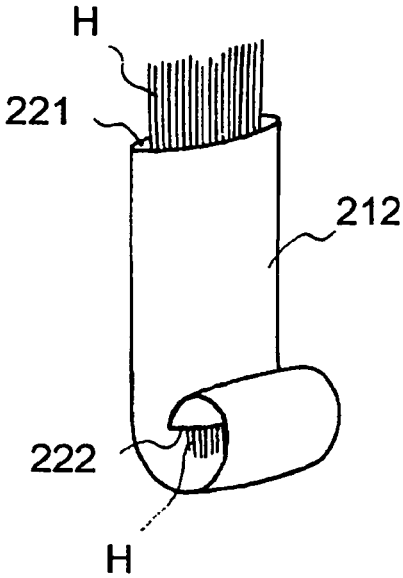
Figure 24D:
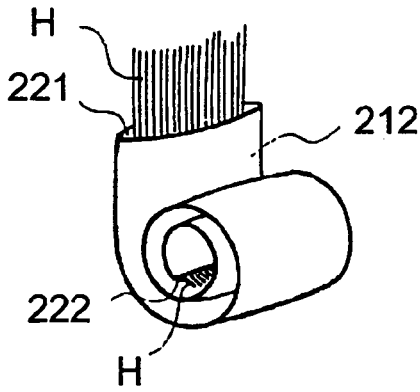

The sheet fabricating the tubes of the hair holders according to the embodiments shown in FIGS. 18 through 22 may have any shape and any surface condition as far as it is capable of forming tubes of the above-described configurations. The sheet making a flat shape may have a textured surface. The tube of the hair holder according to the present invention may have a trumpet shape as illustrated in FIG. 23, in which case ease of inserting hair is improved.

The hair holders of the embodiments shown in FIGS. 18 through 22 do not always need to be combined with a curling member. Where the hair holder is used without a curling member, the hair holder having a strand of hair inserted therein is rolled up by hand. Curling hair by a permanent wave, for instance, will be described by referring to FIG. 24. To begin with, a hair holder 200 having a tube 212 with suitable Taber stiffness, length, and width is chosen according to the volume of a strand of hair H to be curled and a desired shape of the curl. As shown in FIG. 24(*a*), the opening 221 at one end of the tube 212 is widened into an elliptic shape, and the hair H is put in the opening 221. As shown in FIG. 24(*b*), the hair H is inserted through the tube 212 until the tip slightly sticks out of the opening 222 at the other end of the tube 212. After the hair is inserted in the tube 212, the hair holder 200 is rolled from the other end opening 222 of the tube with a desired starting diameter as depicted in FIGS. 24(*c*) and 24(*d*), and the hair H is kept in the rolled state by means of a well-known fixing member, such as a clip (not shown). Thereafter a hair treating agent for permanent waving is applied to the hair from the outside of the tube 212. After an elapse of a given time, the hair H is released from the tube 212 and subjected to post-treatment such as a shampoo to complete permanent waving. If necessary, the opening 221 of the tube 212 is widened into a circular shape when the strand of hair H is inserted therethrough, which will be more helpful to insert the hair H smoothly. The strand of hair H does not always need to be inserted until the tip sticks out of the other end opening 222 of the tube 212.

In using the hair holders of the embodiments shown in FIGS. 18 through 22 without a curling member, they can be rolled to roll the hair in combination with a curling rod as has conventionally been used. Where the hair holders 200 whose tubes 212 are formed of a liquid impermeable sheet(s) are used for permanent waving, a hair treating agent for permanent waving is injected into the tube from its opening 221. The hair holders having no curling member are applicable to not only hair curling by a permanent wave treatment but other hair curling methods, such as blowing hot air from a hair drier to the inserted and rolled strand of hair, keeping a strand of dry hair in a rolled state, or keeping a strand of wet hair in a rolled state and letting the hair to dry spontaneously. The hair holders are useful not only for curling the tip of hair but for setting hair into a wavy form or a helical form.

The hairdressing tools according to the embodiments shown in FIGS. 25 through 33 each comprise a slender tubular hair holder having a hair inlet at one end thereof and a longitudinally extending space for hair insertion, the space being so designed that a strand of hair winds therethrough. Unlike the hairdressing tools of the embodiments described above, these hairdressing tools are capable of curling hair without using a curling member.

Figure 25A:
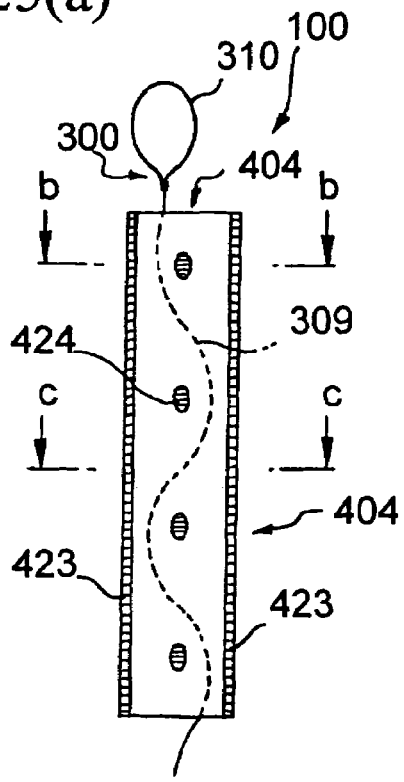
FIG. 25(*a*) is a plan showing another embodiment of a hairdressing tool, and FIG. 25(*b*) and FIG. 25(*c*) are cross-sections taken along line b-b and line c-c in FIG. 25(*a*), respectively.
Figure 25B:
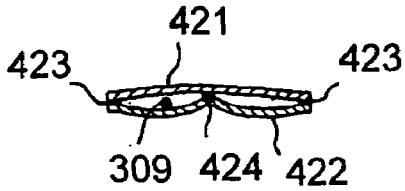
Figure 25C:
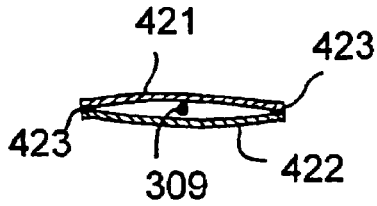

The hairdressing tool 100 shown in FIG. 25 comprises a slender hair holder 400 capable of holding hair and a hair inserter 300. The hair holder 400 is a slender tube formed by fabricating a flexible sheet into a flat bag-like shape. A strand of hair is inserted and held in the hair holder 400. The hair holder 400 has two ends open. The upper end serves as a hair inlet 404. The length of the hair holder 400 is decided appropriately according to the length of hair to be treated and is preferably greater than the length of hair to be treated. The length of the hair holder 400 is usually in a range of about 50 to 600 mm. The width is usually from about 10 to 150 mm.

The hair holder 400 is composed of two strip-shaped sheets 421 and 422. The sheets 421 and 422 are of the same shape, and their both sides are joined together by prescribed means to make side joints 423 and 423. The sheets 421 and 422 are also joined discretely along their longitudinal centerlines, forming a number of center joints 424 in spots spaced at given intervals. The distance between adjacent center joints 424 is adjusted appropriately depending on to what extent hair is to be waved. That distance is usually about 10 to 100 mm. These joints 423 and 424 form a space inside the hair holder 400. As described later, the space is such that hair may wind it way in the flat hair holder 400.

Various flexible materials are used to make the hair holder 400. Examples include nonwoven fabric, porous or nonporous resin films, paper, resin meshes, and composites thereof, from which an appropriate one is selected according to the particular use of the hair holder 400. For instance, in case where a hair treating agent is to be applied to the hair inserted in the hair holder 400 through the wall of the hair holder 400, a material permeable to the hair treating agent is chosen.

The hair inserter 300 is used in a state inserted in the hair holder 400, more specifically with its hair catching member 310 being disposed by the side of the hair inlet 404 of the hair holder 400 as shown in FIG. 25(*a*). The pulling member 309 of the hair inserter 300 passes through the space in the hair holder 400 with its tailing end sticking out of the lower end of the hair holder 400. As illustrated in FIG. 25(*a*), the pulling member 309 passes across between adjacent center joints 424. As a result, the pulling member 309 depicts a two-dimensional winding or wavy line in the flat hair holder 400.

Figure 26A:
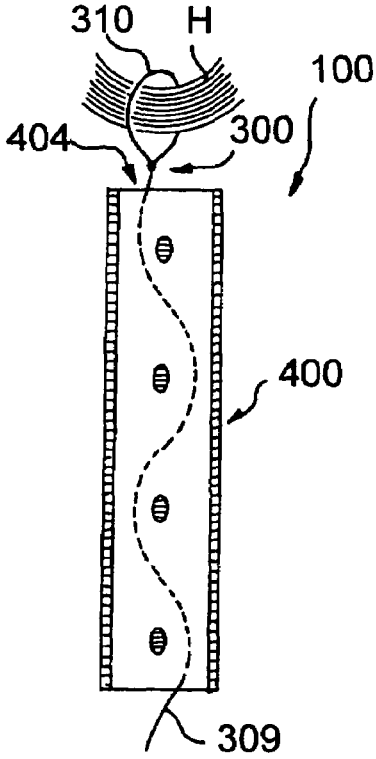
FIG. 26(*a*) and FIG. 26(*b*) illustrate how to use the hairdressing tool.
Figure 26B:
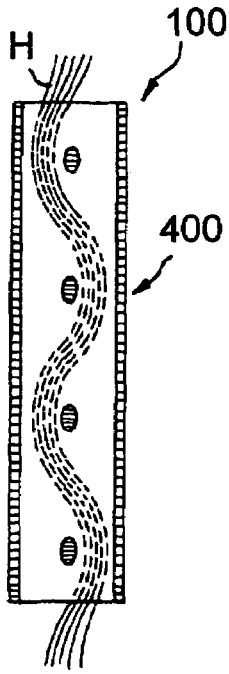

Usage of the hairdressing tool 100 according to the present embodiment will be explained by referring to FIGS. 26(*a*) and 26(*b*). The hair inserter 300 is set to stick the hair catching member 310 out of the hair inlet 104. A desired amount of hair H is caught on the hair catching member 310, and the pulling member 309 of the hair inserter 300 is pulled by the tail extending from the lower end of the hair holder 400. The hair H caught on the hair catching member 310 is thus inserted into the hair holder 400 together with the hair catching member 310. Since the pulling member 309 winds its way flat in the hair holder 400 as shown in FIG. 26(*a*), the hair H, as dragged into the hair holder 400 by the hair catching member 310, snakes down in the flat hair holder 400 as shown in FIG. 26(*b*). The hair catching member 300 is drawn out of the hair holder 400 from the lower end opening.

Because the hair H inserted in the hair holder 400 is maintained there in a winding form, leaving the hair H in this state for a long time results in setting the hair H into a wavy shape.

Where the hair holder 400 is made of a material permeable to a hair treating agent such as a permanent waving preparation, such as a nonwoven fabric or a resin-made mesh, the hair treating agent can be applied from the outside of the hair holder 400 to carry out a permanent wave treatment.

Figure 27A:
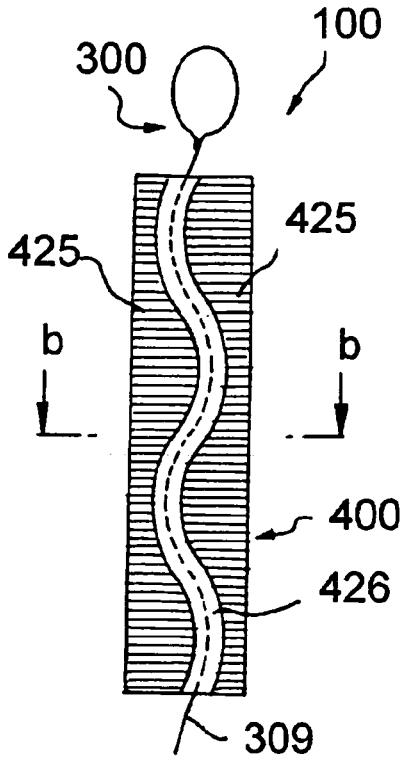
FIG. 27(*a*) is a plan showing another embodiment of a hairdressing tool, and FIG. 27(*b*) is a cross-section taken along line b-b in FIG. 27(*a*).
Figure 27B:
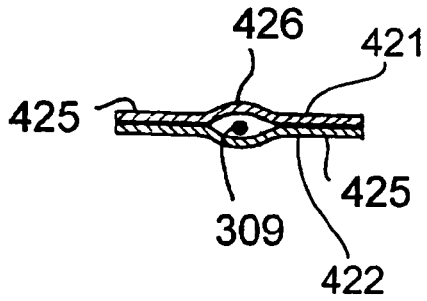
Figure 28A:
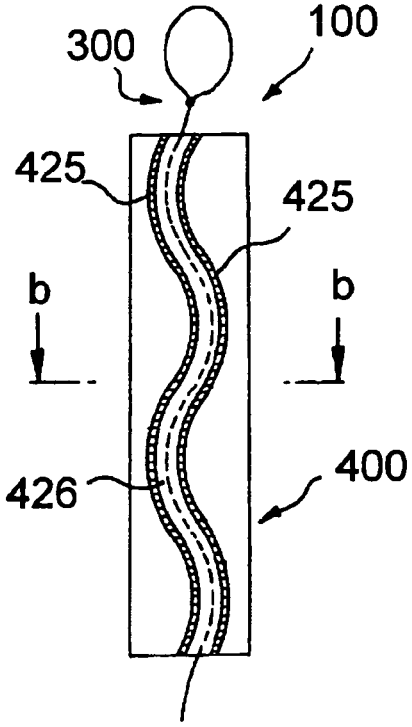
FIG. 28(*a*) is a plan showing another embodiment of a hairdressing tool, and FIG. 28(*b*) is a cross-section taken along line b-b in FIG. 28(*a*).
Figure 28B:
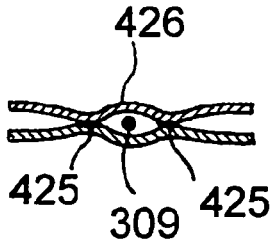

In each of the embodiment shown in FIGS. 27(*a*) and 27(*b*) and the embodiment shown in FIGS. 28(*a*) and 28(*b*), the hair holder 400 is formed of two strip-shaped sheets 421 and 422, which are joined together to make joined portions 425 and a non-joined portion 426. The joined portions 425 are disposed in such a configuration that the two sheets 421 and 422 in the non-joined portion 426 may form a space winding across the longitudinal centerline of the hair holder 400 over the length of the hair holder 400. The difference between the embodiments of FIGS. 27(*a*) and FIGS. 28(*a*) is this: the joined portions 425 cover all the area other than the non-joined portion 426 making the space in the embodiment shown in FIG. 27(*a*), whereas the joined portion 425 is linear and provided on only each side of the non-joined portion 426 so that the sheets 421 and 422 are not joined in their side areas in the embodiment shown in FIG. 28(*a*). In both embodiments, the degree of the space's winding is adjusted appropriately depending on to what extent the hair is to be waved.

Figure 29A:
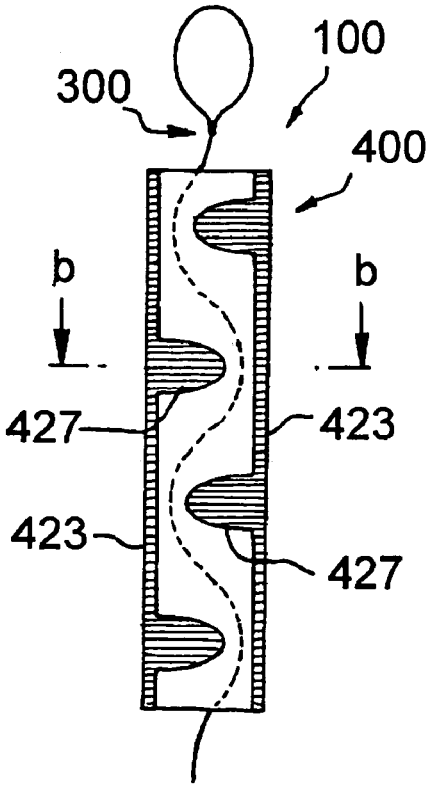
FIG. 29(*a*) is a plan showing another embodiment of a hairdressing tool, and FIG. 29(*b*) is a cross-section taken along line b-b in FIG. 29(*a*).
Figure 29B:
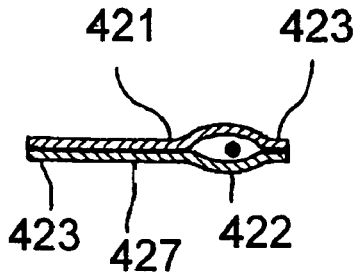

The hair holder 400 of the embodiment shown in FIGS. 29(*a*) and 29(*b*) is fabricated of two strip-shaped sheets 421 and 422, which are joined along their two longer sides to form opposing side joined portions 423 and 423. Each side joined portion 423 extends inwardly to form protruding joined portions 427. The protruding joined portions 427 are arranged at a given interval in the longitudinal direction of the hair holder 400. Each protruding joined portion 427 on one side faces the middle between adjacent protruding joined portions 427 on the other side. In other words, the protruding joined portions 427 on both sides alternate in the longitudinal direction of the hair holder 400. While the protruding joined portions 427 in this particular embodiment have the shape of a round top mountain, the shape of the protruding joined portions 427 is not limited thereto and includes, for example, a triangle and a rectangle. There is thus formed a space in the area other than the joined portions 423 and 427, i.e., the non-joined portion, which space winds across the longitudinal centerline in the longitudinal direction of the hair holder 400.

Figure 30:
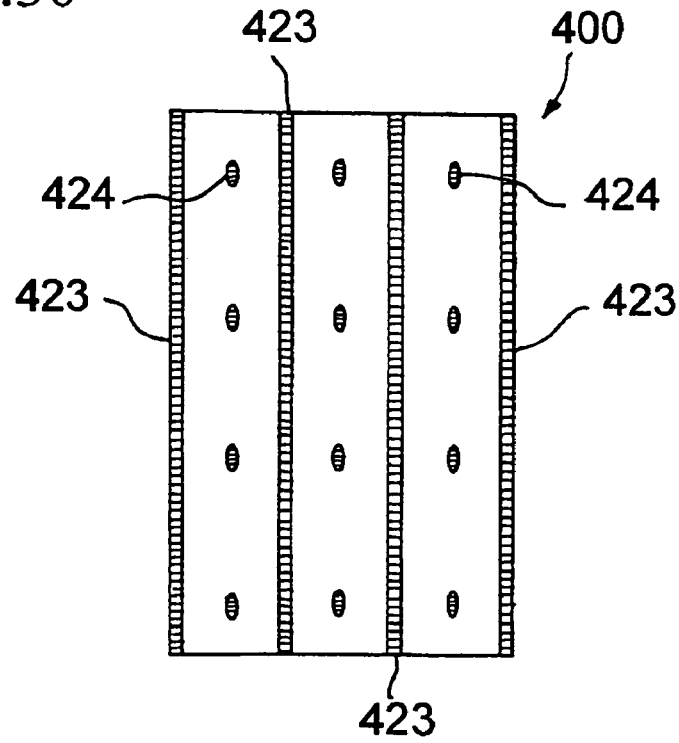
FIG. 30 is a plan showing another embodiment of a hairdressing tool.

The embodiment shown in FIG. 30 is a multiple hair holder 400 composed of a plurality of the hair holders according to the embodiment shown in FIG. 25(*a*). Illustration of the hair inserter is omitted from FIG. 30. The hair holder 400 according to this embodiment is formed by superposing two rectangular sheets one on another and joining them by a number of longitudinally linear joints 423 arranged in the width direction of the sheets at a given interval. The distance between every adjacent joints 423 can be the same as the width of the hair holder shown in FIG. 25(*a*). A number of center joints 424 are formed in spots at a given interval along the longitudinal centerline between every adjacent joints 423. The distance between adjacent center joints 424 can be the same as that in the hair holder of the embodiment shown in FIG. 25(*a*). The hair holder 400 according to this embodiment is capable of waving a larger amount of hair at a time than with the hair holder of the embodiment shown in FIG. 25(*a*).

Figure 31:
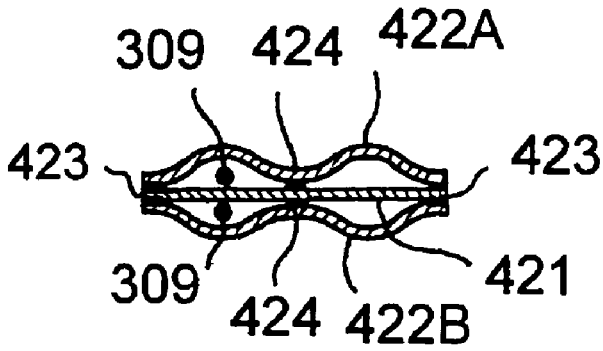
FIG. 31 is a cross-section showing another embodiment of a hairdressing tool.

The embodiment shown in FIG. 31 represents a multiple hair holder 400 composed of a plurality of the hair holders according to the embodiment shown in FIG. 25(*a*) superposed one on another. The hair holder 400 of this embodiment is composed of a strip-shaped sheet 421 and a pair of sheets 422A and 422B having the same shape as the sheet 421 which are superposed on the respective sides of the sheet 421. The sheets 421, 422A, and 422B are joined together along their longer sides with prescribed means to form side joints 423 and 423. The sheets 421, 422A, and 422B are discretely joined together along their longitudinal centerlines to form a number of center joints 424 in spots at a given interval. Similarly to the embodiment shown in FIG. 30, the hair holder 400 according to the present embodiment is capable of waving a larger amount of hair at a time than with the hair holder of FIG. 25(*a*).

Figure 32:
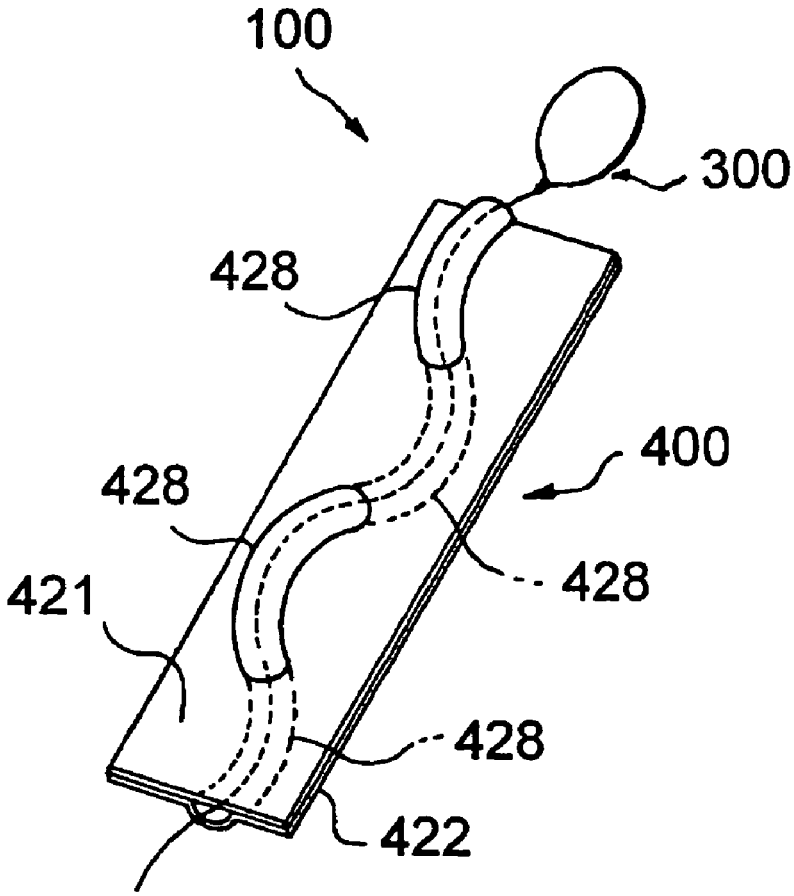
FIG. 32 is a perspective showing another embodiment of a hairdressing tool.

The hair holder 400 according to the embodiment shown in FIG. 32 is composed of strip-shaped sheets 421 and 422 joined together. Each of the sheets 421 and 422 partly protrudes from its plane to form a number of protrusions 428, . . . , and 428 over the length. Each protrusion 428 is formed along the longitudinal centerline of the respective sheets. The protrusions 428 are designed in shape and/or position such that, when the sheets 421 and 422 are joined, the protrusions 428 of the sheet 421 and those of the sheet 422 may face to each other thereby creating a space that winds across the planes of these sheets. The protrusions 428 can be formed by press forming the sheets. In the present embodiment, the space has a tubular shape winding its way at right angles with the planes of the sheets.

Figure 33:
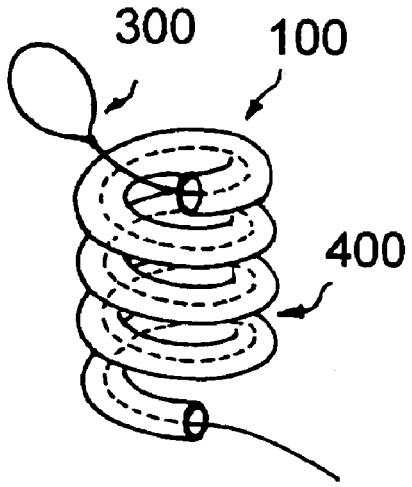
FIG. 33 is a perspective showing another embodiment of a hairdressing tool.

The hair holder 400 according to the embodiment shown in FIG. 33 comprises a circular tube unlike the hair holders of the embodiments described supra. The circular tube is coiled. According to this embodiment, hair is helically curled. The circular tube may be fixed in its helical form and inextensible. Otherwise, the coiled circular tube may be extensible but capable of returning to the illustrated helical form upon being released from the extended state (with no extending force applied). Where the coiled circular tube is extensible, hair is inserted in the circular tube in its extended state, and the tube is released from the extending force, whereby the tube restores its helical shape, which improves the ease of inserting hair.

Figure 34A:
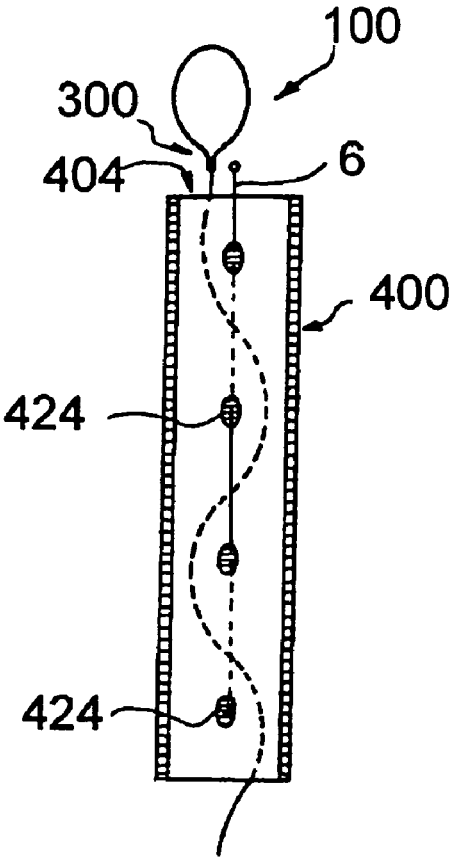
FIG. 34(*a*) schematically illustrates the hair holder of the embodiment shown in FIG. 25(*a*) to which a curling member has been attached, and FIG. 34(*b*) shows the hair holder shown in FIG. 34(*a*) in a folded state.
Figure 34B:
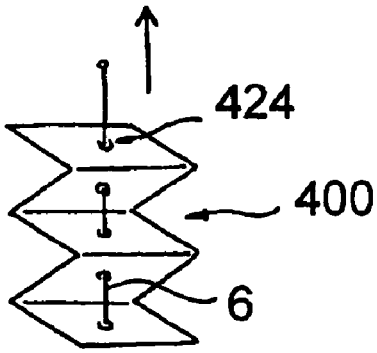

The hair holders of the embodiments shown in FIGS. 25(*a*) through 33 may be used in combination with prescribed means for curling in the same manner as in the embodiments shown in FIGS. 1 to 22. The means for curling includes a method comprising rolling up the hair holder 400 by hand and fixing the rolled state with a clip or a pin and a method in which the hair holder is made self-adhesive. It is also possible to make use of the previously described curling thread or thermal shrinkage as curling means. Inserting hair in the hair holder 400 followed by curling makes it possible to give hair a more complicated three-dimensional wave. For example, a curling thread 6 can be used in, for example, the embodiment of FIG. 25(*a*) as illustrated in FIG. 34(*a*). The curling thread 6 is attached to the hair holder 400 such that it extends in the longitudinal direction of the hair holder 400 and pierces the hair holder as if to work running stitches. That is, the hair holder 400 seen from its front, the curling thread 6 emerges on the front side and the back side of the hair older 400 alternately. The curling thread 6 passes through each of the center joints 424. The curling thread 6 is prevented from being unthreaded at the position of the nearest center joint 424 to the lower end of the hair holder 400. Specifically, the tailing end of the curling thread 6 is fixed to the hair holder 400 at the lowest center joint 424 and thereby prevented from being drawn out. The curling thread 6 is free at its leading end emerging from the nearest center joint 424 to the hair inlet 404.

On pulling the free end of the curling thread 6 attached to the hair holder 400, the hair holder 400 is accordion-folded together with the hair (not shown) as shown in FIG. 34(*b*). As a result, the hair is bent in a zig zag form. The roof of the curling thread 6 emerging from the hair holder 400 is fixed with a clip (not shown) to maintain the bent state. According to this embodiment, hair shaped into a winding form in a plane (i.e., two-dimensionally) is further bent in a zig zag form to create a complicated three-dimensional curl.

The means for rolling is applicable to the embodiments shown in FIGS. 27(*a*) through 32 as well as the embodiment of FIG. 25(*a*). While the hair holders of the embodiments shown in FIGS. 25(*a*) to 32 are composed of a plurality of sheets, they can be formed of a single sheet if desired.

In the various embodiments described above with reference to FIGS. 1 through 34, while a curling member is used to roll up a strand of hair, a curling rod may be used in combination as has been usual.

The hairdressing tool according to the present invention can have a strand of hair taken inside its tube with ease and in a short time. The hairdressing tool of the present invention makes it possible to curl hair easily and rapidly. With the hairdressing tool of the present invention, hair can easily be curled or permanent waved. With the hairdressing tool of the present invention, hair can be curled easily, surely, and neatly.

According to the hairdressing method of the present invention, hairdressing treatments such as permanent waving and coloring can be achieved easily. The hairdressing method of the invention is especially effective in permanent waving and partial coloring.

The invention claimed is:

1. A hairdressing tool comprising:

a slender, circumferentially continuous tubular hair holder having a hair inlet at one end thereof and comprising a flexible material, a hair inserter for inserting hair in or through the hair holder, the hair inserter being capable of being introduced in the slender tubular hair holder to grasp hair and insert the grasped hair through the hair holder, and curling means for rolling, curving or bending the hair held in the hair holder into a prescribed shape by contracting at least the length dimension of the hair holder sufficiently to roll, curve or bend the hair held in the hair holder, wherein the curling means comprises a thread being threaded through the hair holder at several points along the length of the hair holder.

2. The hairdressing tool according to claim 1, wherein the hair inserter has a hair catching member and is adapted to be inserted in the hair holder with the hair catching member being disposed by the side of the hair inlet of the hair holder.

3. The hairdressing tool according to claim 2, wherein the hair catching member is a loop the circumference of which is larger than the circumference of the hair inlet, and the hair catching member is deformable.

4. The hairdressing tool according to claim 2, wherein the hair catching member has comb teeth.

5. The hairdressing tool according to claim 1, wherein the hair inlet and the vicinity thereof are more rigid than the other part of the hair holder.

6. The hairdressing tool according to claim 1 further comprising an auxiliary inserting member, wherein the auxiliary inserting member has an inlet, an outlet, and a passageway connecting the inlet and the outlet in the longitudinal direction thereof, the passageway having a decreasing diameter from the inlet toward the outlet, the hair inserter has a pulling member which passes through the passageway from the inlet to the outlet and then enters the hair holder through the hair inlet.

7. The hairdressing tool according to claim 1, wherein the hair holder has a first side and a second side opposite to the first side, and the first side is provided with a joining member capable of joining the first side to the second side or to itself when the hair holder is rolled, curved or bent into a prescribed shape and thereby capable of maintaining the prescribed shape.

8. The hairdressing tool according to claim 1, wherein the other end of the hair holder is adapted to be opened and closed.

9. The hairdressing tool according to claim 1, wherein the hair holder has a hair treating agent applied to the inner side thereof.

10. The hairdressing tool according to claim 1, wherein at least the part of the hair holder corresponding to half the circumference of the tube's cross-section has a Taber stiffness of 0.4 mN·m or less over the whole length of the hair holder.

11. The hairdressing tool according to claim 1, wherein the hair holder has extensibility in the width direction.

12. The hairdressing tool according to claim 1, wherein the hair holder is a tube formed by folding a rectangular sheet in half along its length and joining the longer sides together.

13. The hairdressing tool according to claim 1, wherein the hair holder is a tube formed by joining two rectangular sheets together along their longer sides, and at least one of the sheets has a Taber stiffness of 0.4 mN·m or less.

14. The hairdressing tool according to claim 1, wherein the hair holder is a tube formed by folding an extensible rectangular sheet in half along its length and joining the longer sides together to form a joint, and the joint along the longer side has no extensibility.

15. The hairdressing tool according to claim 1, wherein the hair holder has the hair inserter previously attached thereto.

16. The hairdressing tool according to claim 1, wherein the hair holder is permeable or impermeable to a hair treating agent.

17. The hairdressing tool according to claim 1, wherein the thread pierces the hair holder in a zig-zag trace at several positions along the length of the hair holder.

* * * * *